US010274183B2

(12) United States Patent
Randolph et al.

(10) Patent No.: US 10,274,183 B2
(45) Date of Patent: Apr. 30, 2019

(54) LIGHTING FIXTURE

(71) Applicant: Cree, Inc., Durham, NC (US)

(72) Inventors: David N. Randolph, Rougemont, NC (US); John R. Rowlette, Jr., Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/649,531

(22) Filed: Oct. 11, 2012

(65) Prior Publication Data

US 2013/0033872 A1 Feb. 7, 2013

Related U.S. Application Data

(63) Continuation-in-part of application No. 13/042,378, filed on Mar. 7, 2011, now Pat. No. 9,371,966.
(Continued)

(51) Int. Cl.
*F21V 17/00* (2006.01)
*F21V 29/507* (2015.01)
(Continued)

(52) U.S. Cl.
CPC ..... *F21V 29/507* (2015.01); *F21K 9/00* (2013.01); *F21S 8/02* (2013.01); *F21S 8/026* (2013.01);
(Continued)

(58) Field of Classification Search
CPC ..... F21V 5/046; F21V 5/048; F21V 7/041; F21V 29/20; F21V 29/22; F21V 29/246; F21V 15/011; F21V 17/05
(Continued)

(56) References Cited

U.S. PATENT DOCUMENTS 1,099,061 A * 6/1914 Lane ..... 362/310
D47,607 S 7/1915 Owen
(Continued)

FOREIGN PATENT DOCUMENTS

CN 3557377 8/2006
CN 201110496 Y 9/2008
(Continued)

OTHER PUBLICATIONS

Examiner's Answer to Appeal Brief for U.S. Appl. No. 13/042,378, dated Aug. 6, 2013, 20 pages
(Continued)

*Primary Examiner* — Julie A Bannan
(74) *Attorney, Agent, or Firm* — Withrow & Terranova, P.L.L.C.

(57) ABSTRACT

The present disclosure relates to a lighting fixture that is configured to transfer heat that is generated by a light source and any associated electronics toward the front of the lighting fixture. The lighting fixture includes a heat spreading cup that is formed from a material that efficiently conducts heat and a light source that is coupled inside the heat spreading cup. The heat spreading cup has a bottom panel, a rim, and at least one sidewall extending between the bottom panel and the rim. The light source is coupled inside the heat spreading cup to the bottom panel and configured to emit light in a forward direction through an opening formed by the rim. Heat generated by the light source during operation is transferred radially outward along the bottom panel and in a forward direction along the at least one sidewall toward the rim of the heat spreading cup.

21 Claims, 31 Drawing Sheets

Related U.S. Application Data

(60) Provisional application No. 61/568,471, filed on Dec. 8, 2011, provisional application No. 61/419,415, filed on Dec. 3, 2010, provisional application No. 61/413,949, filed on Nov. 15, 2010.

(51) Int. Cl.

| | |
|---|---|
| ***F21V 29/71*** | (2015.01) |
| ***F21V 29/00*** | (2015.01) |
| ***F21K 9/00*** | (2016.01) |
| ***F21S 8/02*** | (2006.01) |
| ***F21V 3/02*** | (2006.01) |
| ***F21V 21/04*** | (2006.01) |
| ***F21V 23/00*** | (2015.01) |
| ***F21V 29/70*** | (2015.01) |
| ***F21V 29/77*** | (2015.01) |
| ***F21V 29/85*** | (2015.01) |
| ***F21V 29/89*** | (2015.01) |
| *F21V 19/00* | (2006.01) |
| *F21Y 105/10* | (2016.01) |
| *F21Y 115/10* | (2016.01) |
| *F21Y 113/13* | (2016.01) |

(52) U.S. Cl.
CPC ..... *F21V 3/02* (2013.01); *F21V 17/002* (2013.01); *F21V 17/005* (2013.01); *F21V 21/04* (2013.01); *F21V 23/008* (2013.01); *F21V 29/004* (2013.01); *F21V 29/70* (2015.01); *F21V 29/71* (2015.01); *F21V 29/713* (2015.01); *F21V 29/773* (2015.01); *F21V 29/86* (2015.01); *F21V 29/89* (2015.01); *F21V 19/0055* (2013.01); *F21Y 2105/10* (2016.08); *F21Y 2113/13* (2016.08); *F21Y 2115/10* (2016.08)

(58) Field of Classification Search
USPC ..... 362/249.02, 307, 308, 327–329
See application file for complete search history.

(56) References Cited

U.S. PATENT DOCUMENTS 1,230,844 A 6/1917 Blair et al.
D109,740 S 5/1937 Stewart
D134,595 S 11/1941 van Es
D158,821 S 5/1950 Walter
2,640,148 A 5/1953 McCandless
D199,141 S 9/1964 Curry
D231,679 S 5/1974 Keller
D231,680 S 5/1974 Keller
D238,185 S 12/1975 Wellward et al.
4,466,050 A * 8/1984 Lockard ..... G09F 13/04 362/294
5,034,869 A 7/1991 Choi
5,103,381 A 4/1992 Uke
D325,999 S 5/1992 Sonneman
D326,537 S 5/1992 Gattari
D341,442 S 11/1993 Shapiro
5,477,441 A 12/1995 Budnovitch et al.
D375,605 S 11/1996 Balish, Jr.
D383,564 S 9/1997 Lecluze
5,664,869 A 9/1997 Bitton
D386,805 S 11/1997 Bonnette et al.
D392,764 S 3/1998 Balish, Jr.
D397,472 S 8/1998 Lecluze
D399,021 S 9/1998 Lam
5,800,038 A 9/1998 McCool
D399,590 S 10/1998 Lecluze
D400,274 S 10/1998 Ziaylek, Jr. et al.
D411,640 S 6/1999 Lueken et al.
D413,997 S 9/1999 Jandrisits et al.
5,971,558 A * 10/1999 Peel ..... G01D 11/28 362/23.15
D421,316 S 2/2000 Fiorato
6,100,643 A 8/2000 Nilssen
D433,179 S 10/2000 Johnson
6,147,367 A * 11/2000 Yang ..... H01L 25/075 257/81
6,152,582 A 11/2000 Kaus
6,193,392 B1 2/2001 Lodhie
D457,677 S 5/2002 Landefeld et al.
D459,504 S 6/2002 Chen
D468,044 S 12/2002 Lam
6,491,407 B1 12/2002 Beadle
D468,477 S 1/2003 Landefeld et al.
D473,966 S 4/2003 Lecluze
D474,298 S 5/2003 Lecluze
6,644,834 B2 11/2003 Christen
D488,251 S 4/2004 Benghozi
D488,583 S 4/2004 Benghozi
D506,280 S 6/2005 Chen
6,913,371 B2 7/2005 Ping
D508,141 S 8/2005 Rashidi
D508,750 S 8/2005 Rashidi
D509,017 S 8/2005 Rashidi
D509,615 S 9/2005 Rashidi
6,948,829 B2 * 9/2005 Verdes et al. ..... 362/227
7,213,940 B1 5/2007 Van De Ven et al.
D544,979 S 6/2007 Hartmann, Jr. et al.
D547,484 S 7/2007 Guercio
D548,390 S 8/2007 Lecluze
D549,384 S 8/2007 Grawunder
D558,377 S 12/2007 Rashidi
D558,378 S 12/2007 Rashidi
D560,204 S 1/2008 Bhavnani
D561,374 S 2/2008 Hartmann, Jr. et al.
D570,515 S 6/2008 Flaherty et al.
D574,104 S 7/2008 Sanoner
7,396,146 B2 * 7/2008 Wang ..... 362/294
D588,296 S 3/2009 Sabernig
D588,735 S 3/2009 Woodard
7,502,054 B2 3/2009 Kalapathy et al.
D591,894 S 5/2009 Flank
7,549,772 B2 * 6/2009 Wang ..... 362/294
7,550,931 B2 6/2009 Lys et al.
D596,334 S 7/2009 Sabernig
7,614,769 B2 11/2009 Sell
D606,696 S 12/2009 Chen et al.
D607,140 S 12/2009 Farris et al.
7,631,987 B2 12/2009 Wei
D608,044 S 1/2010 Pickett
D609,840 S 2/2010 Tang
D610,292 S 2/2010 Yoshinobu et al.
7,677,767 B2 * 3/2010 Chyn ..... 362/294
D614,337 S 4/2010 Robinson et al.
D617,934 S 6/2010 Rashidi
D622,434 S 8/2010 Ward et al.
7,771,086 B2 8/2010 Goverde
7,789,535 B2 9/2010 Wang et al.
D625,876 S 10/2010 Chen et al.
D625,879 S 10/2010 Sabernig
D626,676 S 11/2010 Johnson
D628,733 S 12/2010 Cobb, III et al.
7,862,214 B2 1/2011 Trott et al.
7,867,794 B2 * 1/2011 Kimura ..... H01L 33/62 438/27
D632,822 S 2/2011 Bitton
D646,429 S 10/2011 Sabernig
8,104,928 B1 1/2012 Horn
D655,855 S 3/2012 Sabernig
D656,263 S 3/2012 Ogawa et al.
8,240,871 B2 8/2012 Chou
D671,259 S 11/2012 Chen
D671,668 S 11/2012 Rowlette, Jr. et al.
D672,899 S 12/2012 Van De Ven et al.
D674,127 S 1/2013 Rowlette, Jr. et al.
D692,171 S 10/2013 Randolph et al.
D694,456 S 11/2013 Rowlette, Jr. et al.
8,573,816 B2 11/2013 Negley et al.
8,581,499 B2 11/2013 Fries et al.

(56) References Cited

U.S. PATENT DOCUMENTS

| | | | | |
|---|---|---|---|---|
| D695,941 | S | 12/2013 | Rashidi | |
| 8,610,377 | B2 | 12/2013 | Chemel et al. | |
| 8,678,619 | B2 * | 3/2014 | Okazaki | H01L 33/58 257/98 |
| 8,686,646 | B2 | 4/2014 | Tanaka et al. | |
| 8,907,550 | B2 | 12/2014 | Zaderej et al. | |
| 8,952,627 | B2 | 2/2015 | Tomiyama et al. | |
| 9,232,607 | B2 | 1/2016 | Chitta et al. | |
| 9,693,402 | B2 | 6/2017 | Zimmerman et al. | |
| 2002/0047646 | A1 | 4/2002 | Lys et al. | |
| 2004/0050538 | A1 | 3/2004 | Sunder et al. | |
| 2004/0232851 | A1 | 11/2004 | Roach, Jr. et al. | |
| 2005/0111234 | A1 | 5/2005 | Martin et al. | |
| 2006/0044152 | A1 | 3/2006 | Wang | |
| 2006/0245184 | A1 | 11/2006 | Gali | |
| 2006/0263547 | A1 | 11/2006 | Cojocariu et al. | |
| 2007/0019409 | A1 | 1/2007 | Nawashiro et al. | |
| 2007/0035951 | A1 | 2/2007 | Tseng | |
| 2007/0041220 | A1 | 2/2007 | Lynch | |
| 2008/0074889 | A1 | 3/2008 | Gloisten et al. | |
| 2008/0117637 | A1 | 5/2008 | Chang et al. | |
| 2008/0158887 | A1 | 7/2008 | Zhu et al. | |
| 2008/0273754 | A1 | 11/2008 | Hick et al. | |
| 2009/0086492 | A1 * | 4/2009 | Meyer | 362/294 |
| 2009/0161356 | A1 | 6/2009 | Negley et al. | |
| 2009/0219727 | A1 | 9/2009 | Weaver | |
| 2009/0237011 | A1 | 9/2009 | Shah et al. | |
| 2009/0262189 | A1 | 10/2009 | Marman | |
| 2009/0283779 | A1 | 11/2009 | Negley et al. | |
| 2009/0296387 | A1 * | 12/2009 | Reisenauer | F21V 3/00 362/235 |
| 2010/0007289 | A1 | 1/2010 | Budike, Jr. | |
| 2010/0061076 | A1 | 3/2010 | Mandy et al. | |
| 2010/0103671 | A1 * | 4/2010 | Zheng | F21S 8/06 362/235 |
| 2010/0110699 | A1 | 5/2010 | Chou | |
| 2010/0164348 | A1 | 7/2010 | Huang et al. | |
| 2010/0177509 | A1 | 7/2010 | Pickard | |
| 2010/0182294 | A1 | 7/2010 | Roshan et al. | |
| 2010/0195338 | A1 * | 8/2010 | Panagotacos | F21K 9/232 362/471 |
| 2010/0201274 | A1 | 8/2010 | Deixler | |
| 2010/0226139 | A1 | 9/2010 | Lynch et al. | |
| 2010/0262296 | A1 | 10/2010 | Davis et al. | |
| 2010/0270935 | A1 | 10/2010 | Otake et al. | |
| 2010/0295946 | A1 | 11/2010 | Reed et al. | |
| 2010/0296272 | A1 | 11/2010 | Roos et al. | |
| 2010/0296285 | A1 | 11/2010 | Chemel et al. | |
| 2010/0301770 | A1 | 12/2010 | Chemel et al. | |
| 2011/0002124 | A1 | 1/2011 | Chang et al. | |
| 2011/0026261 | A1 | 2/2011 | Kuan | |
| 2011/0095706 | A1 | 4/2011 | Vilmi | |
| 2011/0101868 | A1 | 5/2011 | Weiss | |
| 2011/0133655 | A1 | 6/2011 | Recker et al. | |
| 2011/0182065 | A1 | 7/2011 | Negley | |
| 2011/0204816 | A1 | 8/2011 | Policy et al. | |
| 2011/0255292 | A1 | 10/2011 | Shen | |
| 2012/0026733 | A1 | 2/2012 | Graeber et al. | |
| 2012/0044704 | A1 | 2/2012 | Wilson et al. | |
| 2012/0051068 | A1 | 3/2012 | Pelton et al. | |
| 2012/0119661 | A1 | 5/2012 | Muller | |
| 2012/0140490 | A1 | 6/2012 | Rowlette, Jr. et al. | |
| 2012/0143357 | A1 | 6/2012 | Chemel et al. | |
| 2012/0162980 | A1 | 6/2012 | Mrakovich | |
| 2012/0187845 | A1 | 7/2012 | Saes et al. | |
| 2012/0230028 | A1 | 9/2012 | Foo | |
| 2012/0235579 | A1 | 9/2012 | Chemel et al. | |
| 2013/0027938 | A1 | 1/2013 | Hisayasu | |
| 2013/0051012 | A1 | 2/2013 | Oehle et al. | |
| 2013/0063042 | A1 | 3/2013 | Bora et al. | |
| 2013/0141918 | A1 | 6/2013 | Harbers et al. | |
| 2013/0154831 | A1 | 6/2013 | Gray et al. | |
| 2013/0214665 | A1 | 8/2013 | Nezu | |
| 2013/0293112 | A1 | 11/2013 | Reed et al. | |
| 2013/0307419 | A1 | 11/2013 | Simonian et al. | |
| 2014/0001952 | A1 | 1/2014 | Harris et al. | |
| 2014/0001963 | A1 | 1/2014 | Chobot et al. | |
| 2014/0003061 | A1 | 1/2014 | Chen et al. | |
| 2014/0072211 | A1 | 3/2014 | Kovesi et al. | |
| 2014/0292194 | A1 | 10/2014 | Sagal et al. | |
| 2015/0008829 | A1 | 1/2015 | Lurie et al. | |
| 2015/0008831 | A1 | 1/2015 | Carrigan et al. | |
| 2015/0043216 | A1 | 2/2015 | Du et al. | |
| 2015/0062917 | A1 | 3/2015 | Yin | |
| 2015/0305119 | A1 | 10/2015 | Hidaka et al. | |
| 2015/0373808 | A1 | 12/2015 | Kuo et al. | |
| 2016/0100086 | A1 | 4/2016 | Chien | |

FOREIGN PATENT DOCUMENTS

| | | | |
|---|---|---|---|
| EM | 000380670-0001 | | 8/2005 |
| FR | 2909160 | A1 | 5/2008 |
| WO | 03055273 | A2 | 7/2003 |
| WO | 2008036596 | A1 | 3/2008 |
| WO | 2008059445 | A2 | 5/2008 |
| WO | 2008061082 | A1 | 5/2008 |
| WO | 2008067447 | A1 | 6/2008 |
| WO | 2009111905 | A1 | 9/2009 |
| WO | 2011037878 | A1 | 3/2011 |
| WO | 2011087681 | A1 | 7/2011 |

OTHER PUBLICATIONS

Notice of Allowance for U.S. Appl. No. 29/456,927, dated Sep. 18, 2013, 8 pages

Non-Final Office Action for U.S. Appl. No. 13/042,388, dated Oct. 18, 2013, 12 pages.

Notice of Allowance for U.S. Appl. No. 29/408,234, dated Mar. 14, 2014, 5 pages.

Notice of Allowance for U.S. Appl. No. 29/469,362, dated Mar. 25, 2014, 5 pages.

Quayle Action for U.S. Appl. No. 13/042,388, dated May 27, 2014, 4 pages.

International Search Report for PCT/US2011/062990 dated Apr. 12, 2012, 10 pages.

International Search Report for PCT/US2011/062992 dated Apr. 2, 2012, 12 pages.

International Search Report for PCT/US2012/067754 dated Feb. 20, 2013, 11 pages.

Quayle Action for U.S. Appl. No. 29/379,134 dated May 30, 2012, 6 pages.

Non-final Office Action for U.S. Appl. No. 13/042,378 dated Sep. 4, 2012, 19 pages.

Final Office Action for U.S. Appl. No. 13/042,378 dated Feb. 4, 2013, 20 pages.

Restriction Requirement for U.S. Appl. No. 29/408,232 dated Jan. 16, 2013, 5 pages.

International Preliminary Reports on Patentability for PCT/US2012/067754, dated Jun. 19, 2014, 8 pages.

Notice of Allowance for U.S. Appl. No. 13/042,388, dated Jul. 21, 2014, 9 pages.

International Search Report and Written Opinion for PCT/US2014/023887, dated Jun. 13, 2014, 7 pages.

Non-Final Office Action for U.S. Appl. No. 13/800,656, dated Jun. 4, 2015, 16 pages.

Author Unknown, "White Paper: Breakthrough video technology solves persistent image problems with fluorescent lights and LEDs, while maintaining wide dynamic range," 2009, Pixim, Inc., 7 pages.

Non-Final Office Action for U.S. Appl. No. 13/868,021, dated Apr. 17, 2015, 10 pages.

Final Office Action for U.S. Appl. No. 13/868,021, dated Jul. 23, 2015, 11 pages.

First Office Action for Chinese Patent Application No. 201280023405.6, dated Dec. 9, 2014, 17 pages.

First Office Action for Chinese Patent Application No. 201280058225.7, dated Dec. 17, 2014, 29 pages.

Third Office Action for Chinese Patent Application No. 201180058225.7, dated May 10, 2016, 23 pages.

(56) References Cited

OTHER PUBLICATIONS

Supplemental Notice of Allowance for U.S. Appl. No. 13/042,378, dated May 23, 2016, 4 pages.
Supplemental Notice of Allowance for U.S. Appl. No. 14/073,446, dated May 24, 2016, 4 pages.
Supplemental Notice of Allowance for U.S. Appl. No. 14/073,446, dated Jul. 14, 2016, 4 pages.
Notice of Allowance for U.S. Appl. No. 14/073,428, dated May 23, 2016, 7 pages.
Supplemental Notice of Allowance for U.S. Appl. No. 14/073,428, dated Jun. 7, 2016, 4 pages.
Supplemental Notice of Allowance for U.S. Appl. No. 14/073,428, dated Jul. 18, 2016, 4 pages.
Notice of Allowance and Examiner-Initiated Interview Summary for U.S. Appl. No. 13/042,378, dated Feb. 16, 2016, 12 pages.
Notice of Allowance and Examiner-Initiated Interview Summary for U.S. Appl. No. 14/073,446, dated Apr. 1, 2016, 9 pages.
International Preliminary Report on Patentability for PCT/US2014/023887, dated Sep. 24, 2015, 5 pages.
Examination Report for German Patent Application No. 112012005131.9, dated Aug. 5, 2015, 18 pages.
Examination Report for European Patent Application No. 14723531.1, dated Mar. 14, 2016, 5 pages.
First Examination Report for European Patent Application No. 11793990.0, dated Apr. 5, 2016, 7 pages.
Examination Report for European Patent Application No. 13762691.7, dated Dec. 1, 2017, 6 pages.
Notification of Refusal for German Patent Application No. 112012005131.9, dated Apr. 11, 2016, 13 pages.
Advisory Action for U.S. Appl. No. 13/800,656, dated May 18, 2017, 4 pages.
Advisory Action and Applicant-Initiated Interview Summary for U.S. Appl. No. 13/800,656, dated Aug. 15, 2016, 5 pages.
Non-Final Office Action for U.S. Appl. No. 13/800,656, dated Sep. 22, 2016, 16 pages.
Final Office Action for U.S. Appl. No. 13/800,656, dated May 17, 2016, 15 pages.
Non-Final Office Action for U.S. Appl. No. 13/800,656, dated Dec. 7, 2015, 15 pages.
Non-Final Office Action for U.S. Appl. No. 13/868,021, dated Jun. 27, 2016, 9 pages.
Second Office Action for Chinese Patent Application No. 201180058225.7, dated Oct. 23, 2015, 24 pages.
International Preliminary Report on Patentability for PCT/US2011/062990, dated Jun. 13, 2013, 6 pages.
Decision on Appeal for U.S. Appl. No. 13/042,378, dated Nov. 30, 2015, 15 pages.
Non-Final Office Action for U.S. Appl. No. 14/073,446, dated Nov. 17, 2015, 9 pages.
Non-Final Office Action for U.S. Appl. No. 14/073,428, dated Jan. 11, 2016, 11 pages.
Supplemental Notice of Allowance for U.S. Appl. No. 14/073,428, dated Aug. 17, 2016, 4 pages.
Examination Report for European Patent Application No. 14723531.1, dated Jan. 4, 2017, 4 pages.
Examination Report for European Patent Application No. 13762691.7, dated Dec. 6, 2016, 5 pages.
Non-Final Office Action for U.S. Appl. No. 13/589,899, dated Nov. 2, 2016, 13 pages.
Final Office Action for U.S. Appl. No. 13/868,021, dated Nov. 25, 2016, 11 pages.
Non-Final Office Action for U.S. Appl. No. 14/623,314, dated Oct. 6, 2016, 13 pages.
Final Office Action for U.S. Appl. No. 13/800,656, dated Mar. 13, 2017, 19 pages.
Advisory Action for U.S. Appl. No. 13/868,021, dated Jan. 31, 2017, 2 pages.
Non-Final Office Action for U.S. Appl. No. 13/868,021, dated Mar. 3, 2017, 18 pages.
Examination Report for European Patent Application No. 13762691.7, dated Jun. 2, 2017, 3 pages.
Examination Report for European Patent Application No. 14723531.1, dated Jul. 12, 2017, 4 pages.
Non-Final Office Action and Examiner-Initiated Interview Summary for U.S. Appl. No. 13/800,656, dated Jul. 3, 2017, 16 pages.
Final Office Action for U.S. Appl. No. 13/868,021, dated Jun. 8, 2017, 23 pages.
Corrected Notice of Allowance for U.S. Appl. No. 13/800,656, dated Feb. 14, 2018, 7 pages.
Notice of Allowance for U.S. Appl. No. 13/800,656, dated Jan. 4, 2018, 10 pages.
Corrected Notice of Allowance for U.S. Appl. No. 13/800,656, dated Feb. 1, 2018, 7 pages.
Final Office Action for U.S. Appl. No. 13/800,656, dated Oct. 13, 2017, 10 pages.
Advisory Action and Examiner-Initiated Interview Summary for U.S. Appl. No. 13/868,021, dated Aug. 29, 2017, 3 pages.
Non-Final Office Action for U.S. Appl. No. 13/868,021, dated Sep. 21, 2017, 23 pages.
Fifth Office Action for Chinese Patent Application No. 201180058225.7, dated Aug. 4, 2017, 7 pages.
Fourth Office Action for Chinese Patent Application No. 201180058225.7, dated Nov. 3, 2016, 7 pages.
Ex Parte Quayle Action for U.S. Appl. No. 15/783,505, dated Oct. 15, 2018, 6 pages.
Notice of Allowance for U.S. Appl. No. 15/783,505, dated Feb. 15, 2019, 7 pages.

* cited by examiner

LIGHTING FIXTURE

RELATED APPLICATIONS

This application claims the benefit of U.S. Provisional Patent Application No. 61/568,471 filed Dec. 8, 2011, and is a continuation-in-part of U.S. patent application Ser. No. 13/042,378 filed Mar. 7, 2011, now U.S. Pat. No. 9,371,966, which claims the benefit of U.S. Provisional Patent Application Nos. 61/419,415 filed Dec. 3, 2010 and 61/413,949 filed Nov. 15, 2010, the disclosures of which are incorporated herein by reference in their entireties. This application is also related to U.S. patent application Ser. No. 13/042,388, now U.S. Pat. No. 8,894,253, which claims the benefit of U.S. Provisional Patent Application No. 61/419,415, filed Dec. 3, 2010, the disclosures of which are incorporated herein by reference in their entireties.

FIELD OF THE DISCLOSURE

The present disclosure relates to lighting fixtures.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

SUMMARY

The present disclosure relates to a lighting fixture that has a lens assembly including a skirt and a primary lens portion. The skirt extends inside a mounting structure of the lighting fixture, and the primary lens portion is coupled to the skirt, projects in the forward direction substantially past the rim, and covers the opening provided by the rim.

The primary lens portion may take on various shapes, such as a dome shape in a first embodiment. In a second embodiment, the primary lens portion includes a dome portion and a cylindrical portion that extends between the dome portion and the skirt. In a third embodiment, the primary lens portion includes a bulbous portion and a base portion that extends between the bulbous portion and the skirt. In a fourth embodiment, the primary lens portion includes a conical portion and a cylindrical portion that extends between the conical portion and the skirt. In a fifth embodiment, the primary lens portion includes a planar lens and a cylindrical portion that extends between the planar lens and the skirt. In a sixth embodiment, the primary lens portion includes a multi-tubular portion and a cylindrical portion that extends between the multi-tubular portion and the skirt.

In select embodiments, the mounting structure of the lighting fixture is configured to transfer heat that is generated by the light source and any associated electronics toward the front of the lighting fixture. In one embodiment, the lighting fixture includes a mounting structure in the shape of a heat spreading cup that is formed from a material that efficiently conducts heat, and a light source that is coupled inside the heat spreading cup. The heat spreading cup has a bottom panel, a rim, and at least one sidewall extending between the bottom panel and the rim. The light source is coupled inside the heat spreading cup to the bottom panel and is configured to emit light in a forward direction through an opening formed by the rim. The light source is thermally coupled to the bottom panel such that heat generated by the light source during operation is transferred radially outward along the bottom panel and in a forward direction along the at least one sidewall toward the rim of the heat spreading cup.

The lighting fixture may optionally include a reflector. The reflector has a body extending between a smaller opening, which is substantially adjacent and open to the light emitting element of the light source, and a larger opening that is biased toward the opening formed by the rim. To control the light source, a control module may be coupled to an exterior surface of the bottom panel. The control module is thermally coupled to the exterior surface of the bottom panel such that heat generated by the electronics during operation is transferred radially outward along the bottom panel and in a forward direction along the at least one sidewall toward the rim. In certain embodiments, a majority of the heat that is generated from the electronics and light emitting source and transferred to the bottom panel is transferred radially outward along the bottom panel and in a forward direction along the at least one sidewall toward the rim.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
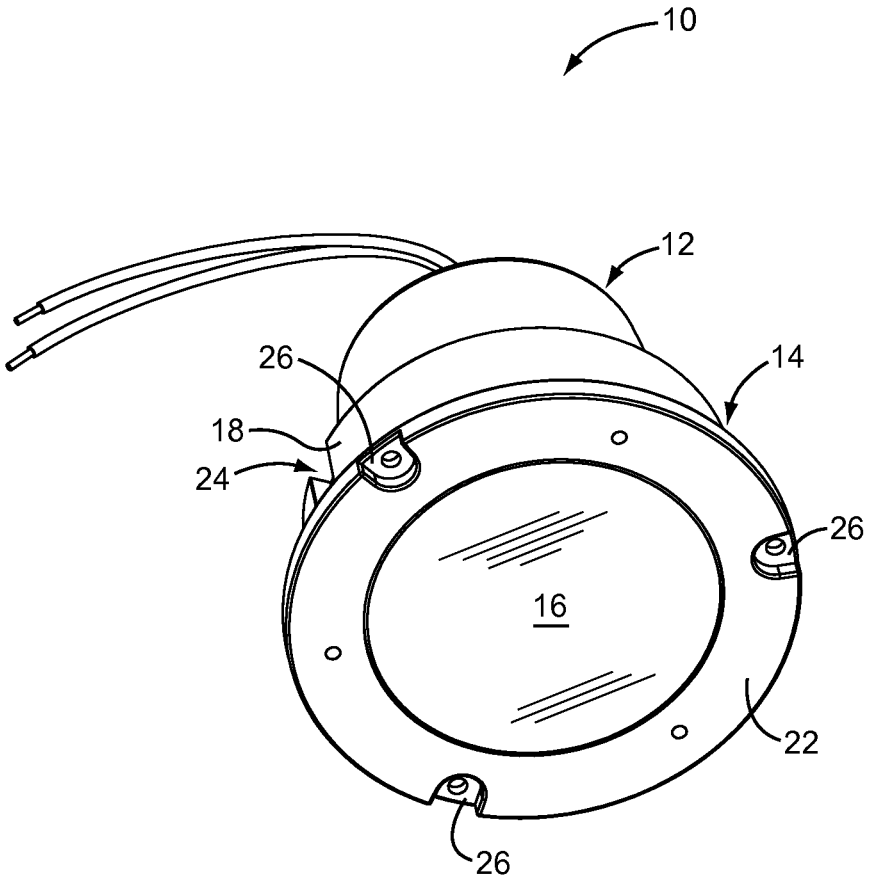
FIG. 1 is an isometric view of the front of the lighting fixture according to one embodiment of the disclosure.
Figure 2:
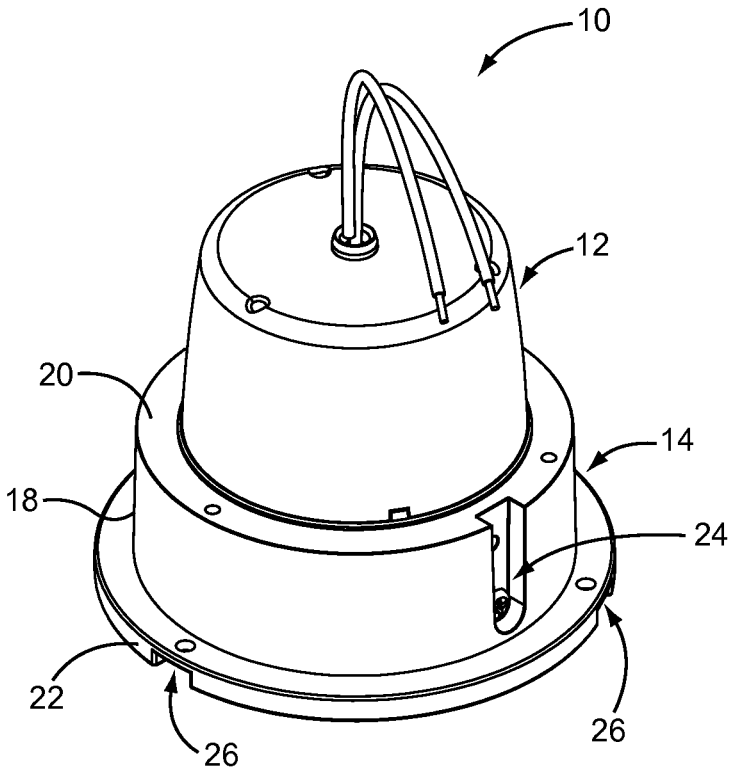
FIG. 2 is an isometric view of the back of the lighting fixture of FIG. 1.
Figure 3:
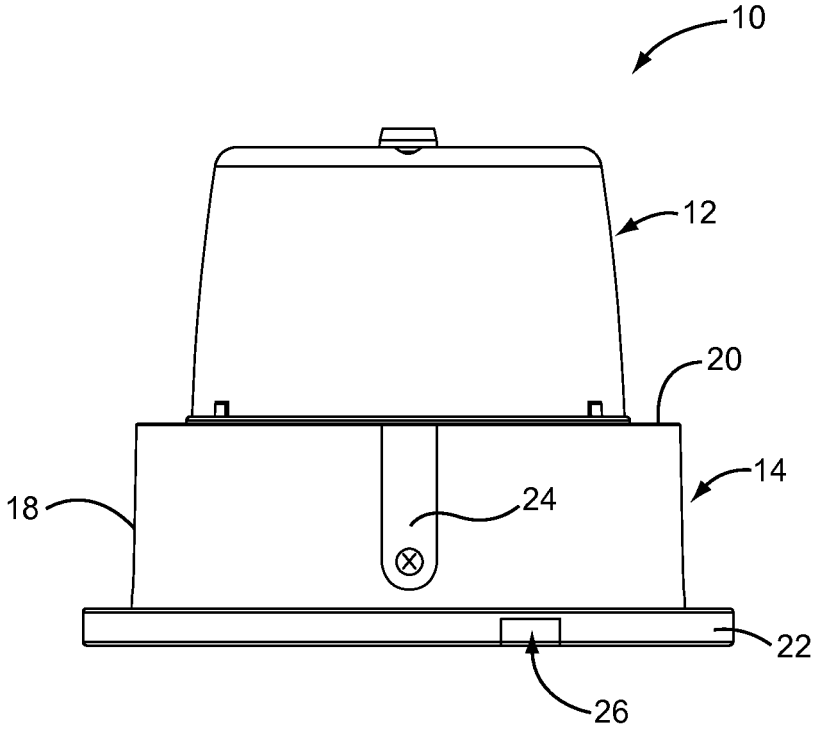
FIG. 3 is a side plan view of the lighting fixture of FIG. 1.

With reference to FIGS. 1-3, a lighting fixture 10 is illustrated according to one embodiment of the present disclosure. As shown, the lighting fixture 10 includes a control module 12, a heat spreading cup 14 that acts as a mounting structure, and a lens assembly 16. A light source (not shown), which will be described in detail further below, is mounted inside the heat spreading cup 14 and oriented such that light is emitted from the heat spreading cup through the lens assembly 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, those skilled in the art will recognize the concepts disclosed herein are applicable to virtually any size and application.

The lens assembly 16 may include one or more lenses that are made of clear or transparent materials, such as polycarbonate or acrylic. The lens assembly 16 may include a diffuser for diffusing the light emanated from the light source and exiting the heat spreading cup 14 via the lens assembly 16. Further, the lens assembly 16 may also be configured to shape or direct the light exiting the heat spreading cup 14 via the lens assembly 16 in a desired manner.

The control module 12 and the heat spreading cup 14 may be integrated and provided by a single structure. Alternatively, the control module 12 and the heat spreading cup 14 may be modular wherein different sizes, shapes, and types of control modules 12 may be attached, or otherwise connected, to the heat spreading cup 14 and used to drive the light source provided therein.

The heat spreading cup 14 is made of a material that provides good thermal conductivity, such as metal, ceramic, or the like. In the disclosed embodiment, the heat spreading cup 14 is formed from aluminum, but other metals, or thermally conductive materials, are applicable. Lighting fixtures, such as the illustrated lighting fixture 10, are particularly beneficial for recessed lighting applications wherein most, if not all of the lighting fixture 10 is recessed into a cavity within a wall, ceiling, cabinet, or like structure. Heat generated by the light source or electronics of the control module 12 is often trapped within the cavity. After prolonged operation, even an efficient lighting fixture 10 can cause sufficient heat to be trapped in the cavity, which may cause damage to the lighting fixture 10 itself or its surroundings.

Historically, fixture designers have placed heat sinks near the rear of lighting fixtures in an effort to transfer heat away from the light source or control electronics. Unfortunately, transferring heat toward the rear of the lighting fixtures effectively transfers the heat directly into the cavity in which the lighting fixture is mounted. As a result, the cavity heats up to a point where the heat sink no longer functions to transfer heat from the control electronics or light source, and damage to the lighting fixture ensues.

Instead of directing heat transfer toward the rear of the lighting fixture 10 and into the cavity in which the lighting fixture 10 is mounted, the lighting fixture 10 of the present disclosure employs the heat spreading cup 14 to direct heat transfer toward the front of the lighting fixture 10. Even when mounted into a cavity, the front of the lighting fixture 10 is either exposed to ambient, or in select embodiments, coupled to a mounting can that is also exposed to ambient. By directing heat transfer toward the front of the lighting fixture 10, the amount of heat that would otherwise be directed into the cavity in which the lighting fixture 10 is mounted is significantly reduced. By reducing the amount of heat directed toward the rear of the lighting fixture 10, the performance and longevity of the lighting fixture 10 may be enhanced, the number of acceptable mounting conditions and applications may be increased, the cost of the lighting fixture 10 may be reduced by being able to use less expensive components, or any combination thereof.

In the illustrated embodiment, the heat spreading cup 14 is cup-shaped and includes a sidewall 18 that extends between a bottom panel 20 at the rear of the heat spreading cup 14, and a rim, which may be provided by an annular flange 22 at the front of the heat spreading cup 14. One or more elongated slots 24 may be formed in the outside surface of the sidewall 18. As illustrated, there are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the heat spreading cup 14 inside the elongated slot 24, connecting additional elements to the lighting fixture 10, or as described further below, securely attaching the lens assembly 16 to the heat spreading cup 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 4:
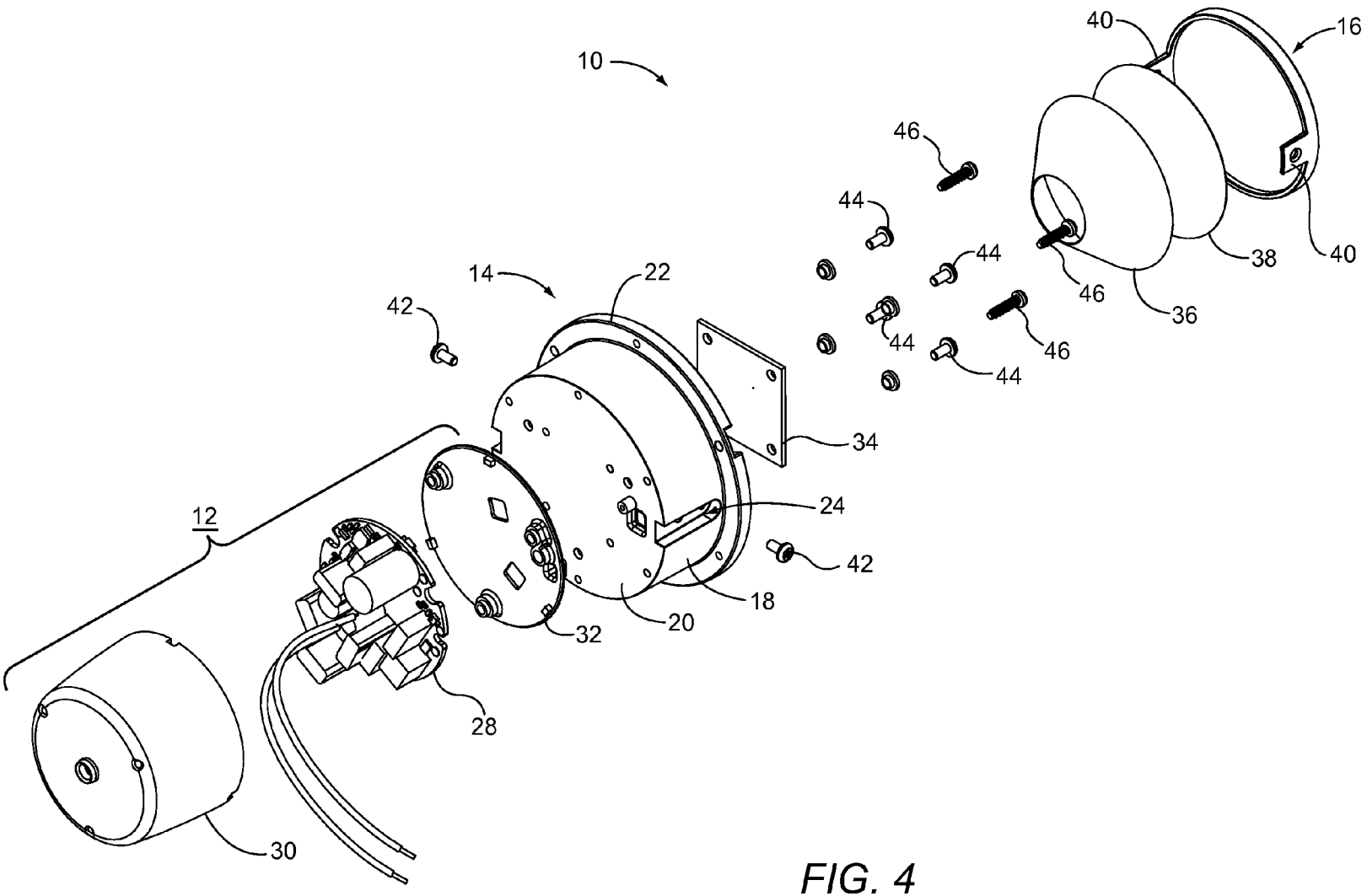
FIG. 4 is an exploded isometric view of the lighting fixture of FIG. 1.

With reference to FIG. 4, an exploded view of the lighting fixture 10 of FIGS. 1-3 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the heat spreading cup 14.

The control module electronics 28 may be used to provide all or a portion of power and control signals necessary to power and control the light source 34, which may be mounted on the front surface of the bottom panel 20 of the heat spreading cup 14. Aligned holes or openings in the bottom panel 20 of the heat spreading cup 14 and the control module cover 32 are provided to facilitate an electrical connection between the control module electronics 28 and the light source 34. In the illustrated embodiment, the light source 34 is solid state and employs one or more light emitting diodes (LEDs) and associated electronics, which are mounted to a printed circuit board (PCB) to generate light at a desired magnitude and color temperature. The LEDs are mounted on the front side of the PCB while the rear side of the PCB is mounted to the front surface of the bottom panel 20 of the heat spreading cup 14 directly or via a thermally conductive pad (not shown). The thermally conductive pad has a low thermal resistivity, and therefore, efficiently transfers heat that is generated by the light source 34 to the bottom panel 20 of the heat spreading cup 14. While an LED-based light source is the focus herein, other lighting technologies, such as but not limited to high-intensity discharge (HID) bulbs, readily benefit from the disclosed concepts.

While various mounting mechanisms are available, the illustrated embodiment employs four bolts 44 to attach the PCB of the light source 34 to the front surface of the bottom panel 20 of the heat spreading cup 14. The bolts 44 screw into threaded holes provided in the front surface of the bottom panel 20 of the heat spreading cup 14. Three bolts 46 are used to attach the heat spreading cup 14 to the control module 12. In this particular configuration, the bolts 46 extend through corresponding holes provided in the heat spreading cup 14 and the control module cover 32 and screw into threaded apertures (not shown) provided just inside the rim of the control module housing 30. As such, the bolts 46 effectively sandwich the control module cover 32 between the heat spreading cup 14 and the control module housing 30.

A reflector cone 36 resides within the interior chamber provided by the heat spreading cup 14. In the illustrated embodiment, the reflector cone 36 has a conical wall that extends between a larger front opening and a smaller rear opening. The larger front opening resides at and substantially corresponds to the dimensions of front opening in the heat spreading cup 14 that corresponds to the front of the interior chamber provided by the heat spreading cup 14. The smaller rear opening of the reflector cone 36 resides about and substantially corresponds to the size of the LED or array of LEDs provided by the light source 34. The front surface of the reflector cone 36 is generally, but not necessarily, highly reflective in an effort to increase the overall efficiency of the lighting fixture 10. In one embodiment, the reflector cone 36 is formed from metal, paper, a polymer, or a combination thereof. In essence, the reflector cone 36 provides a mixing chamber for light emitted from the light source 34, and as described further below, may be used to help direct or control how the light exits the mixing chamber through the lens assembly 16.

Figure 5:
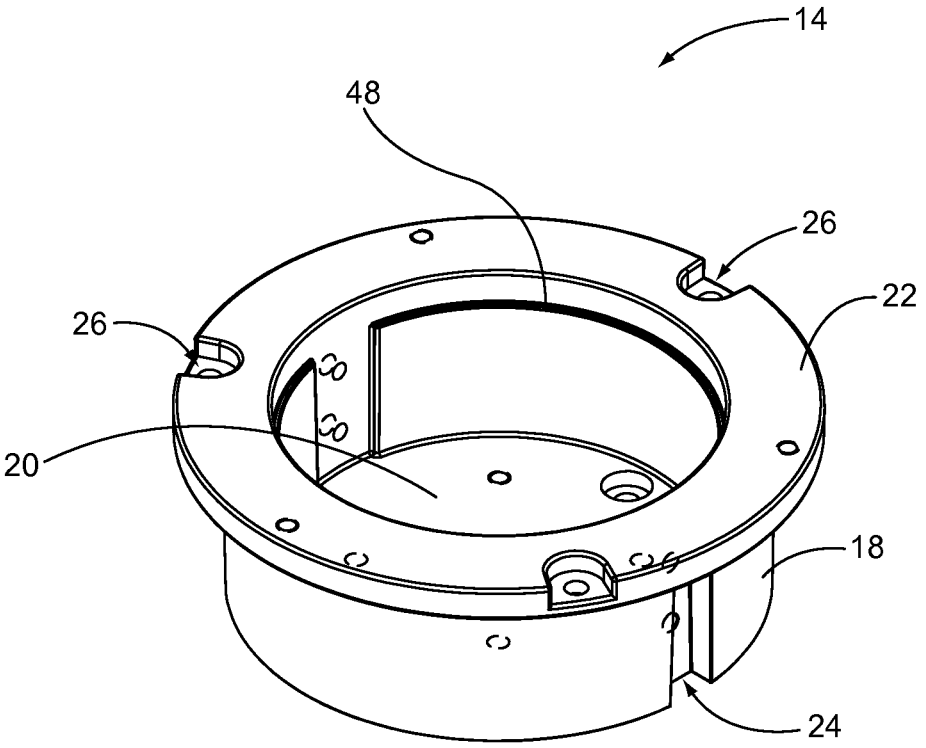
FIG. 5 is an isometric view of the front of the heat spreading cup of the lighting fixture of FIG. 1.
Figure 6:
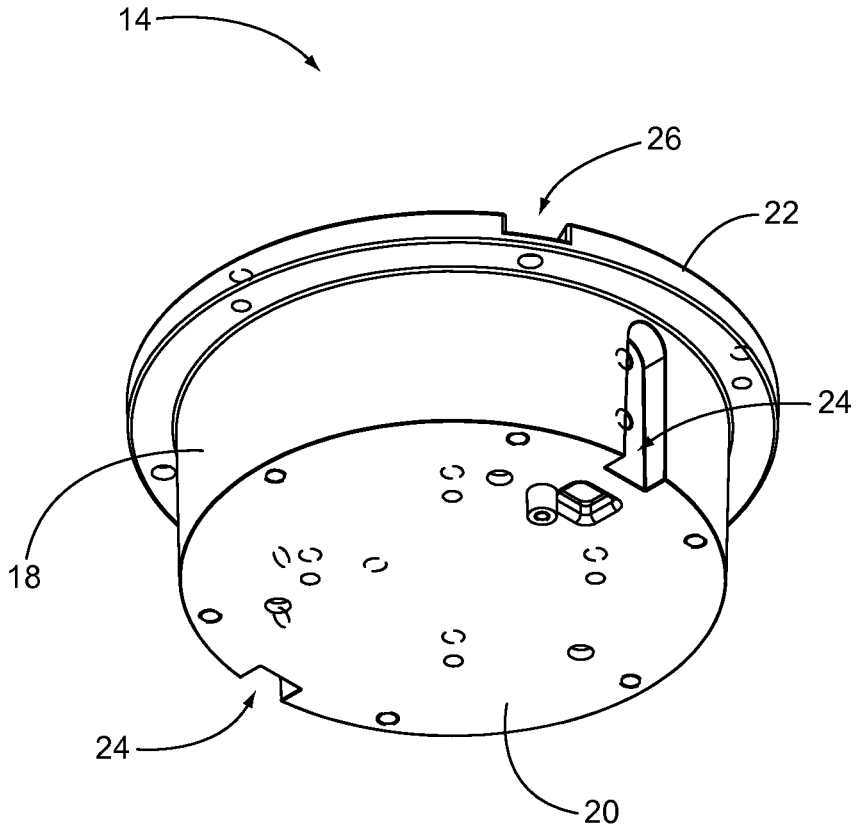
FIG. 6 is an isometric view of the rear of the heat spreading cup of the lighting fixture of FIG. 1.

When assembled, the lens assembly 16 is mounted on or to the annular flange 22 and may be used to hold the reflector cone 36 in place within the interior chamber of the heat spreading cup 14 as well as hold additional lenses and one or more diffusers 38 in place. In the illustrated embodiment, the lens assembly 16 and the diffuser 38 generally correspond in shape and size to the front opening of the heat spreading cup 14 and are mounted such that the front surface of the lens is substantially flush with the front surface of the annular flange 22. As shown in FIGS. 5 and 6, a recess 48 is provided on the interior surface of the sidewall 18 and substantially around the opening of the heat spreading cup 14. The recess 48 provides a ledge on which the diffuser 38 and the lens assembly 16 rest inside the heat spreading cup 14. The recess 48 may be sufficiently deep such that the front surface of the lens assembly 16 is flush with the front surface of the annular flange 22.

Returning to FIG. 4, the lens assembly 16 may include tabs 40, which extend rearward from the outer periphery of the lens assembly 16. The tabs 40 may slide into corresponding channels on the interior surface of the sidewall 18 (see FIGS. 5 and 7). The channels are aligned with corresponding elongated slots 24 on the exterior of the sidewall 18. The tabs 40 have threaded holes that align with holes provided in the grooves and elongated slots 24. When the lens assembly 16 resides in the recess 48 at the front opening of the heat spreading cup 14, the holes in the tabs 40 will align with the holes in the elongated slots 24. Bolts 42 may be inserted through the holes in the elongated slots and screwed into the holes provided in the tabs 40 to affix the lens assembly 16 to the heat spreading cup 14. When the lens assembly 16 is secured, the diffuser 38 is sandwiched between the lens assembly and the recess 48, and the reflector cone 36 is contained between the diffuser 38 and the light source 34.

The degree and type of diffusion provided by the diffuser 38 may vary from one embodiment to another. Further, color, translucency, or opaqueness of the diffuser 38 may vary from one embodiment to another. Diffusers 38 are typically formed from a polymer or glass, but other materials are viable. Similarly, the lens assembly 16 includes a planar lens, which generally corresponds to the shape and size of the diffuser 38 as well as the front opening of the heat spreading cup 14. As with the diffuser 38, the material, color, translucency, or opaqueness of the lens or lenses provided by the lens assembly 16 may vary from one embodiment to another. Further, both the diffuser 38 and the lens assembly 16 may be formed from one or more materials or one or more layers of the same or different materials. While only one diffuser 38 and one lens (in lens assembly 16) are depicted, the lighting fixture 10 may have multiple diffusers 38 or lenses; no diffuser 38; no lens; or an integrated diffuser and lens (not shown) in place of the illustrated diffuser 38 and lens.

Figure 7:
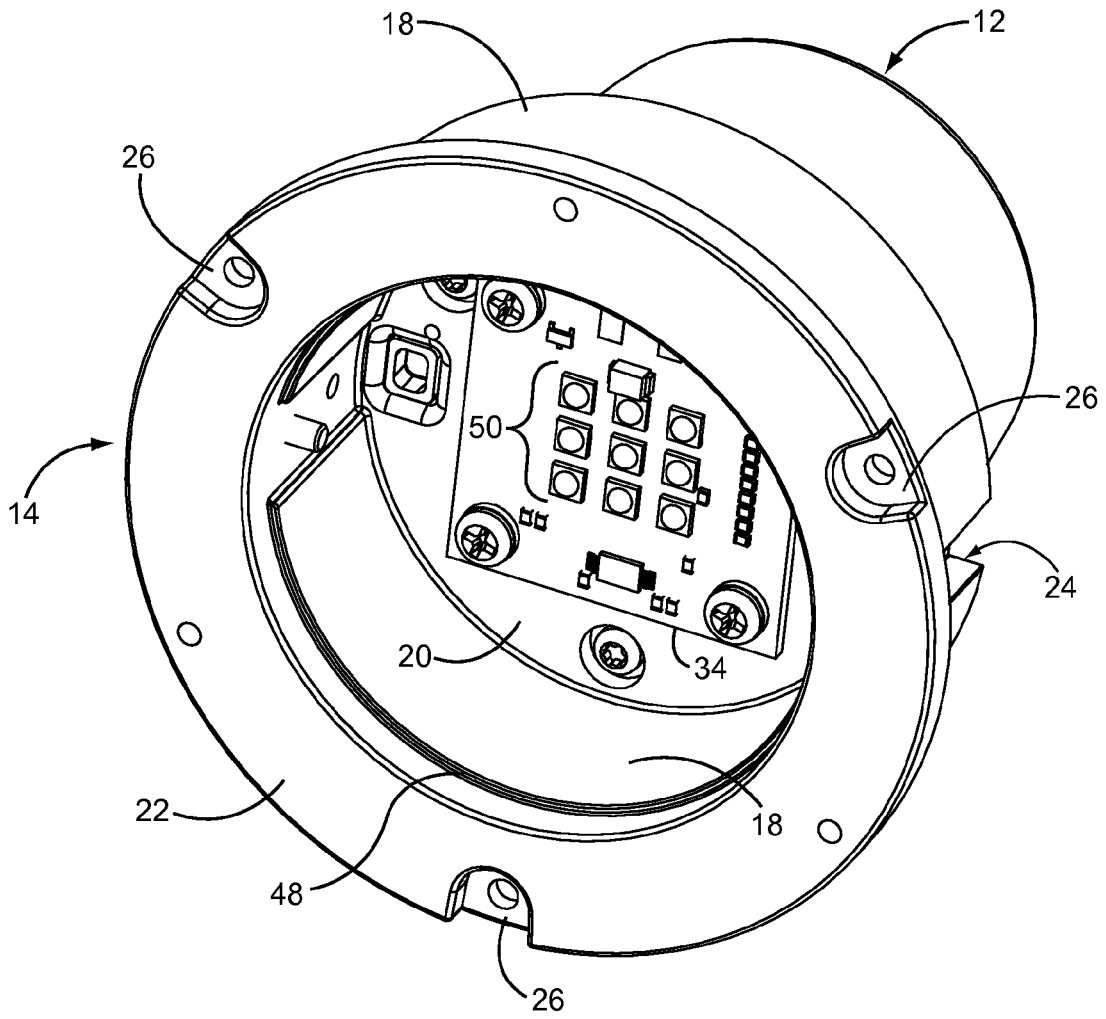
FIG. 7 is an isometric view of the front of the lighting fixture of FIG. 1 without the lens assembly, diffuser, and reflector.

For LED-based applications, the light source 34 provides an array of LEDs 50, as illustrated in FIG. 7. FIG. 7 illustrates a front isometric view of the lighting fixture 10, with the lens assembly 16, diffuser 38, and reflector cone 36 removed. Light emitted from the array of LEDs 50 is mixed inside the mixing chamber formed by the reflector cone 36 (not shown) and directed out through the lens assembly 16 in a forward direction to form a light beam. The array of LEDs 50 of the light source 34 may include LEDs 50 that emit different colors of light. For example, the array of LEDs 50 may include both red LEDs 50 that emit red light and blue-shifted green LEDs 50 that emit bluish-green light, wherein the red and bluish-green light is mixed to form "white" light at a desired color temperature. For a uniformly colored light beam, relatively thorough mixing of the light emitted from the array of LEDs 50 is desired. Both the mixing chamber provided by the reflector cone 36 and the diffuser 38 play a role in mixing the light emanated from the array of LEDs 50 of the light source 34.

Certain light rays, which are referred to as non-reflected light rays, emanate from the array of LEDs 50 and exit the mixing chamber through the diffuser 38 and lens assembly 16 without being reflected off of the interior surface of the reflector cone 36. Other light rays, which are referred to as reflected light rays, emanate from the array of LEDs of the light source 34 and are reflected off of the front surface of the reflector cone 36 one or more times before exiting the mixing chamber through the diffuser 38 and lens assembly 16. With these reflections, the reflected light rays are effectively mixed with each other and at least some of the non-reflected light rays within the mixing chamber before exiting the mixing chamber through the diffuser 38 and the lens assembly 16.

As noted above, the diffuser 38 functions to diffuse, and as result mix, the non-reflected and reflected light rays as they exit the mixing chamber, wherein the mixing chamber and the diffuser 38 provide sufficient mixing of the light emanated from the array of LEDs 50 of the light source 34 to provide a light beam of a consistent color. In addition to mixing light rays, the diffuser 38 may be designed and the reflector cone 36 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight.

Figure 8:
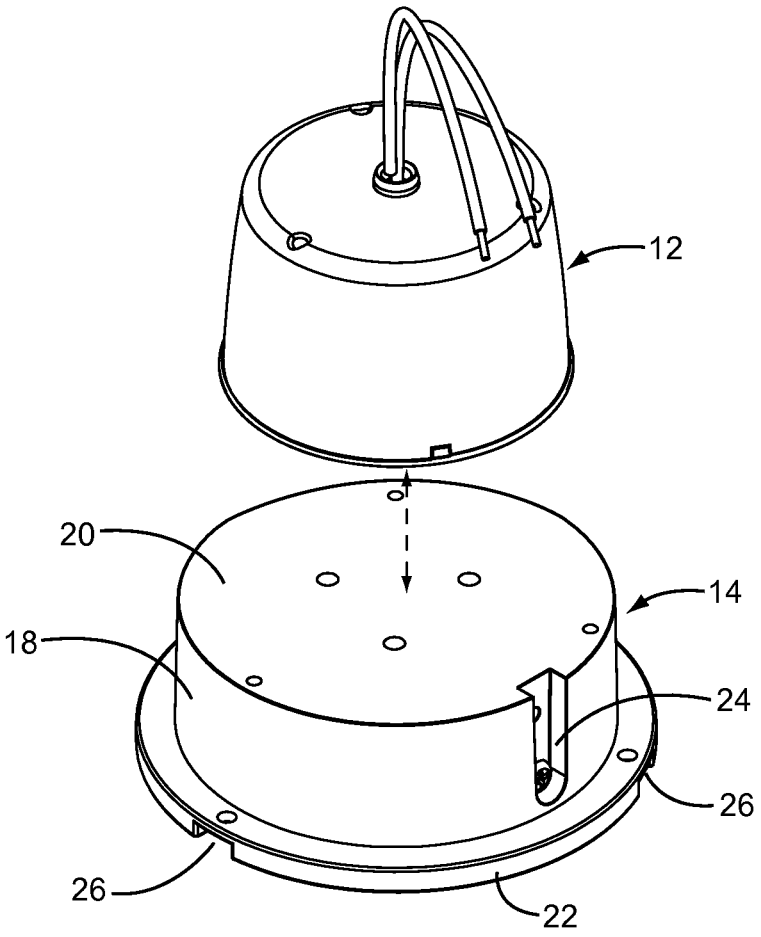
FIG. 8 illustrates the separation of the control module and heat spreading cup of the lighting fixture.

In select embodiments, the lighting fixture 10 is designed to work with different types of control modules 12 wherein different control modules 12 may interchangeably attach to the heat spreading cup 14, and can be used to drive the light source 34 provided in the heat spreading cup 14. As illustrated in FIG. 8, the control module 12 is readily attached to and detached from the heat spreading cup 14 wherein plugs or apertures are provided in each device to facilitate the necessary electrical connection between the two devices. As such, different manufactures are empowered to design and manufacture control modules 12 for another manufacture's heat spreading cup 14 and light source 34 assembly, and vice versa. Further, different sizes, shapes, and sizes of control modules 12 may be manufactured for a given heat spreading cup 14 and light source 34 assembly, and vice versa.

Figure 9:
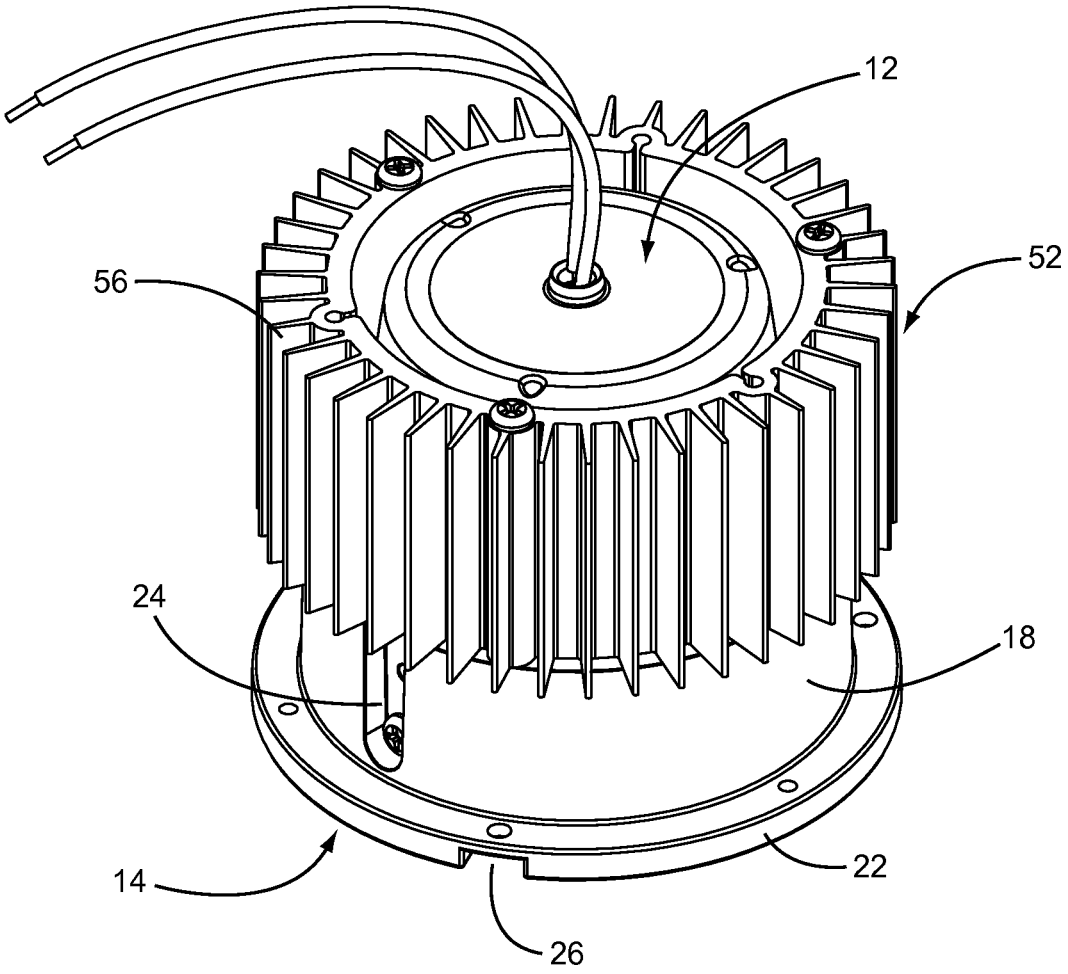
FIG. 9 is an isometric view of the rear of the lighting fixture of FIG. 1 with an optional heat sink.
Figure 10:
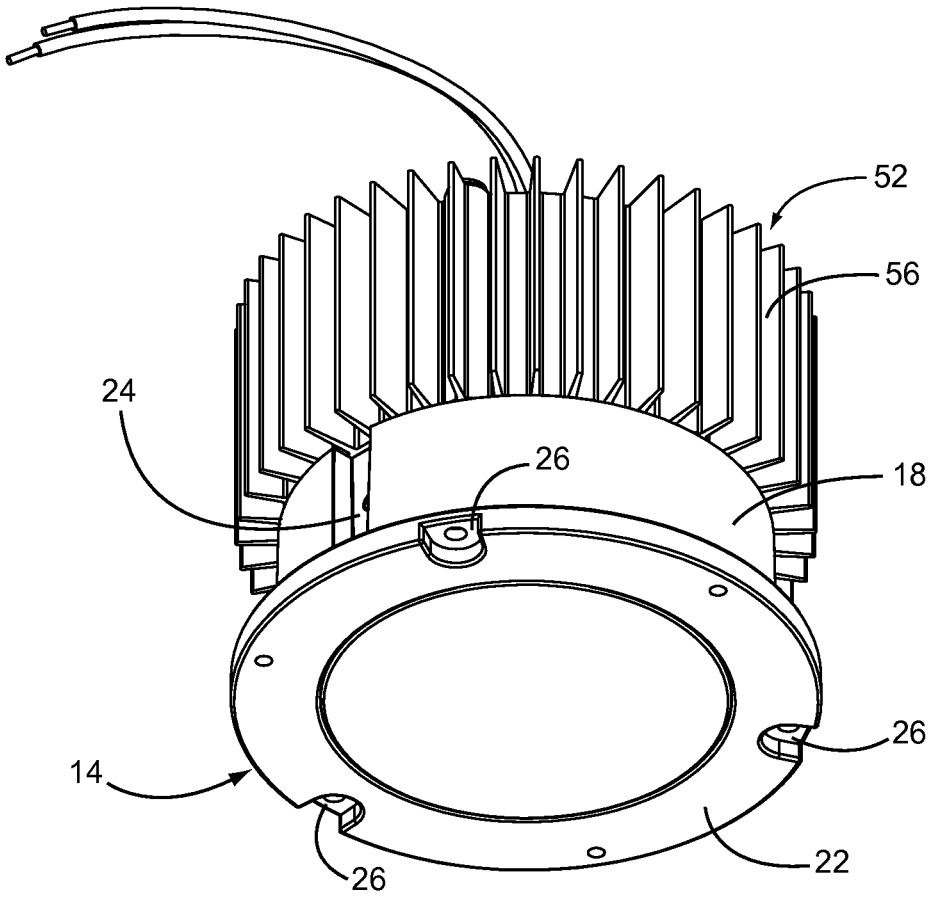
FIG. 10 is an isometric view of the front of the heat spreading cup of the lighting fixture of FIG. 1 with an optional heat sink.

With reference to FIGS. 9 and 10, an optional heat sink 52 may be provided for the lighting fixture 10. In the illustrated embodiment, the heat sink 52 is substantially cylindrical and provides an interior opening that is sized to receive the control module 12 and rest against an outer portion of the rear surface of the bottom panel 20 of the heat spreading cup 14. The heat sink 52 includes radial fins 56 that are substantially parallel to the central axis of the lighting fixture 10. A thermally conductive pad or other material may be provided between the heat sink 52 and the heat spreading cup 14 to enhance the thermal coupling of the heat sink 52 and the heat spreading cup 14.

Without the heat sink 52, most of the heat generated by the control module electronics 28 and the light source 34 is transferred outward to the sidewall 18 via the bottom panel 20 of the heat spreading cup 14, and then forward along the sidewall 18 to the front of the lighting fixture 10. As such, a significant amount, if not a majority, of the heat is transferred to the front of the lighting fixture 10, instead of being transferred to the rear of the lighting fixture where it may be trapped within the cavity in which the lighting fixture is mounted. In embodiments where the heat sink 52 is provided, a certain amount of the heat that is transferred outward along the bottom panel 20 of the heat spreading cup 14 will be transferred rearward to the heat sink 52 while a certain amount of the heat is transferred forward along the sidewall 18.

Figure 11:
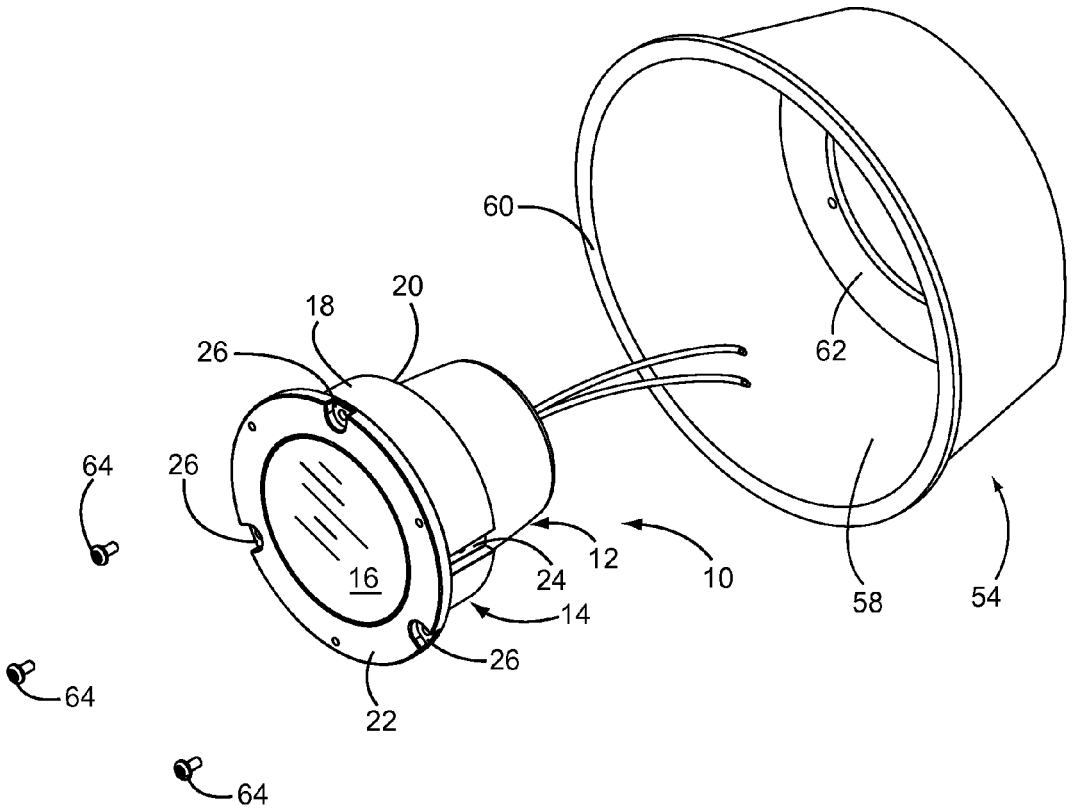
FIG. 11 is an exploded isometric view of the lighting fixture of FIG. 1 and a mounting can.
Figure 13:
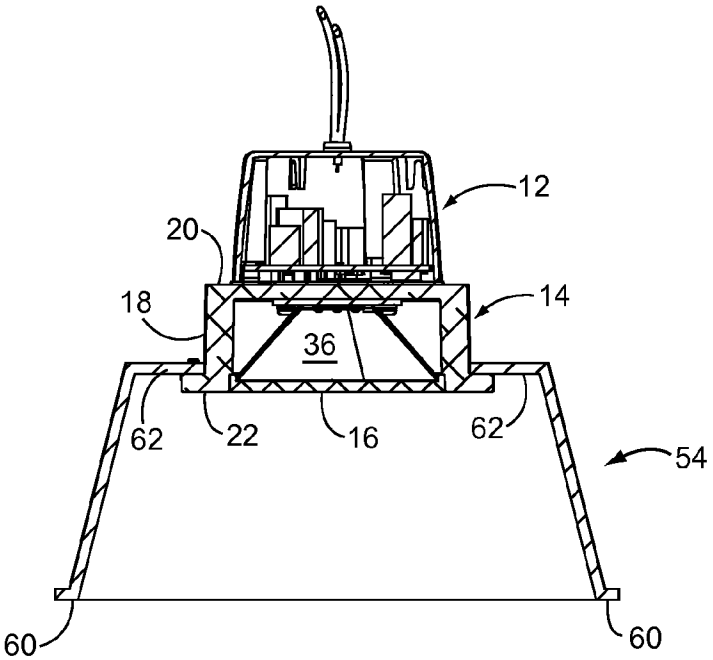
FIG. 13 is a cross sectional view of the assembly of FIG. 11 along line A-A illustrated in FIG. 12.
Figure 12:
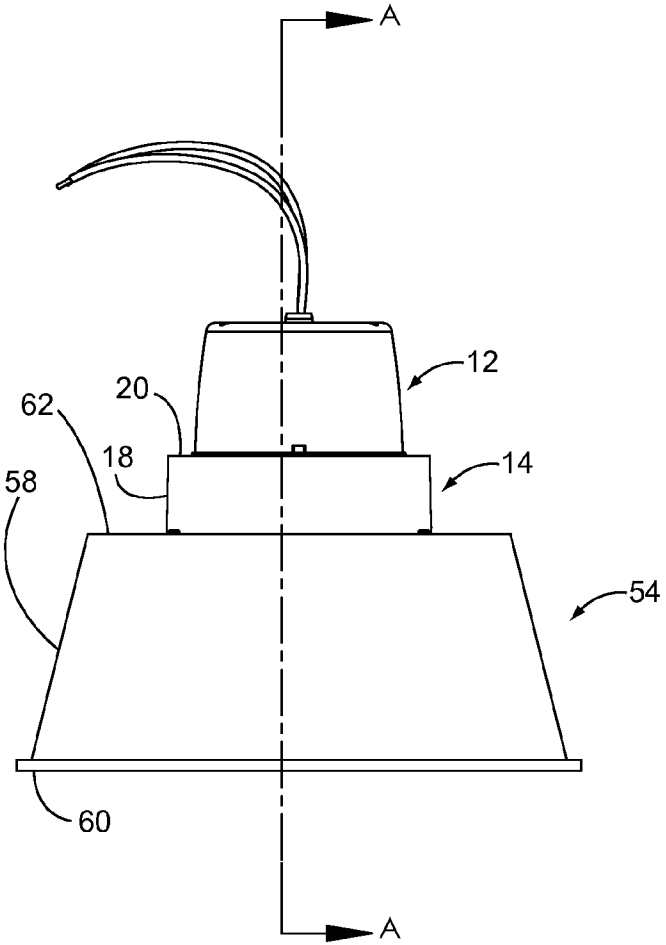
FIG. 12 is a side plan view of the assembly of FIG. 11.

The lighting fixture 10 may be used in conjunction with any number of accessories. An exemplary accessory, such as a mounting can 54, is shown in FIGS. 11-13. In the illustrated embodiment, the mounting can 54 has a substantially cylindrical sidewall 58 extending between a forward edge 60 and an annular flange 62. The annular flange 62 has a circular opening that is slightly larger in diameter than the sidewall 18 of the heat spreading cup 14 while smaller in diameter than the outside periphery of the annular flange 22 of the heat spreading cup 14. As illustrated in FIGS. 12 and 13, the lighting fixture 10 is mounted in the mounting can 54 such that the control module 12 and the rear portion of the heat spreading cup 14 extend through the opening in the annular flange 62 of the mounting can 54. In particular, the rear surface of the annular flange 22 of the heat spreading cup 14 rests against the front surface of the annular flange 62 of the mounting can 54. Bolts 64 may be used to attach the heat spreading cup 14, and thus the entirety of the lighting fixture 10, to the annular flange 62 of the mounting can 54. The bolts 64 extend through holes provided in the recesses 26 and screw into threaded holes provided in the annular flange 62 of the mounting can 54.

As noted above, the heat spreading cup 14 functions to transfer heat that is generated from the light source 34 and the control module electronics 28 forward toward and to the annular flange 22. As a result, the heat is transferred toward ambient and away from the cavity into which the rear of the lighting fixture 10 extends. If the mounting can 54 is of a material that conducts heat, the heat transfer from the light source 34 and the control module electronics 28 may be further transferred from the annular flange 22 of the heat spreading cup 14 to the annular flange 62 of the mounting can 54. Once transferred to the annular flange 62, the heat is transferred outward to the sidewall 58 and then forward along the sidewall 58 toward the lip 60 of the mounting can 54. In essence, the mounting can 54 may operate as a heat spreading extension to the heat spreading cup 14 of the lighting fixture 10. To act as a heat spreading extension, the mounting can 54 may be made of a material with a low thermal resistivity, such as copper, thermally conductive plastic or polymer, aluminum, or an aluminum alloy.

Figure 14:
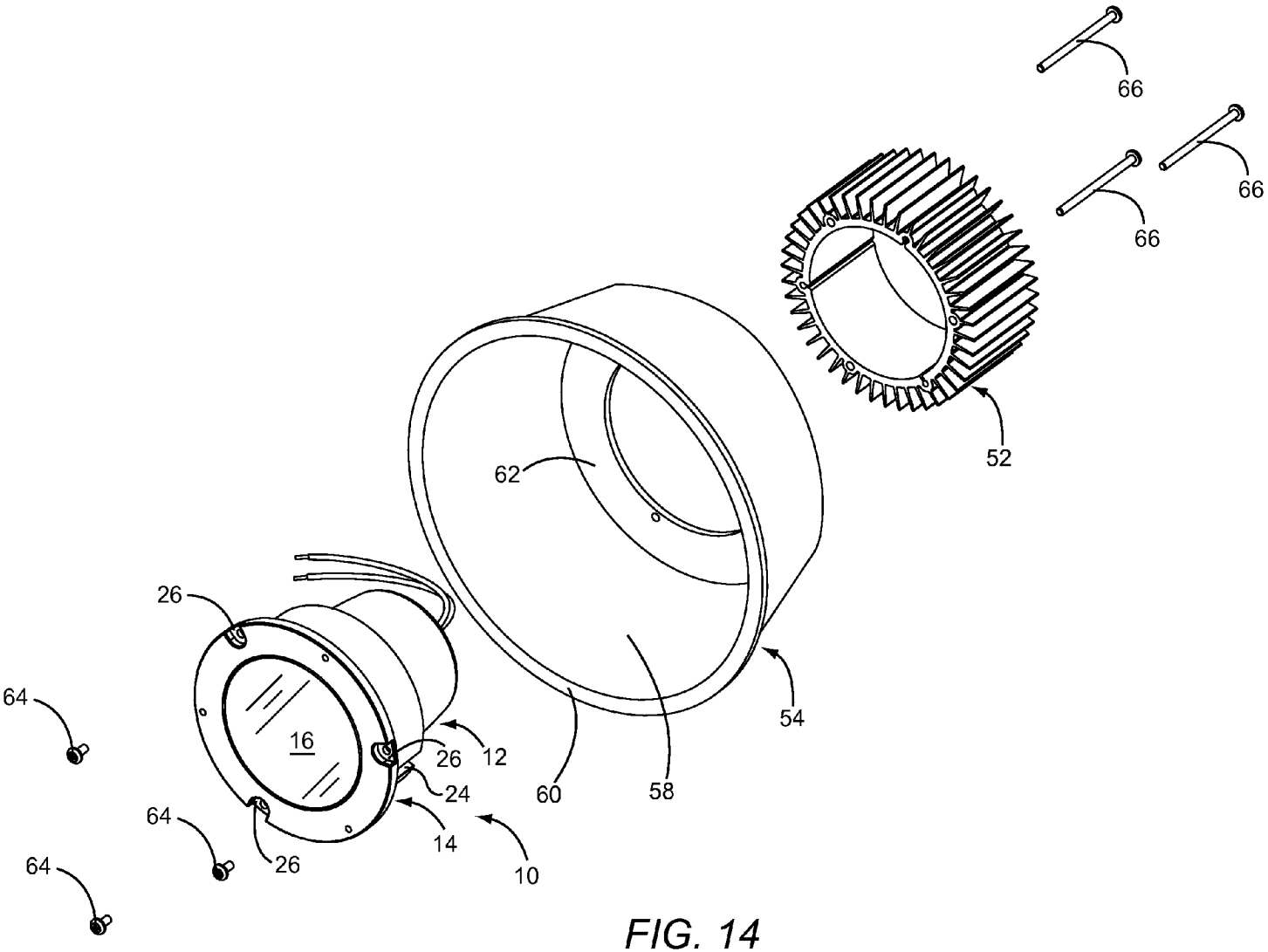
FIG. 14 is an exploded isometric view of the lighting fixture of FIG. 1, a mounting can, and a heat sink.
Figure 15:
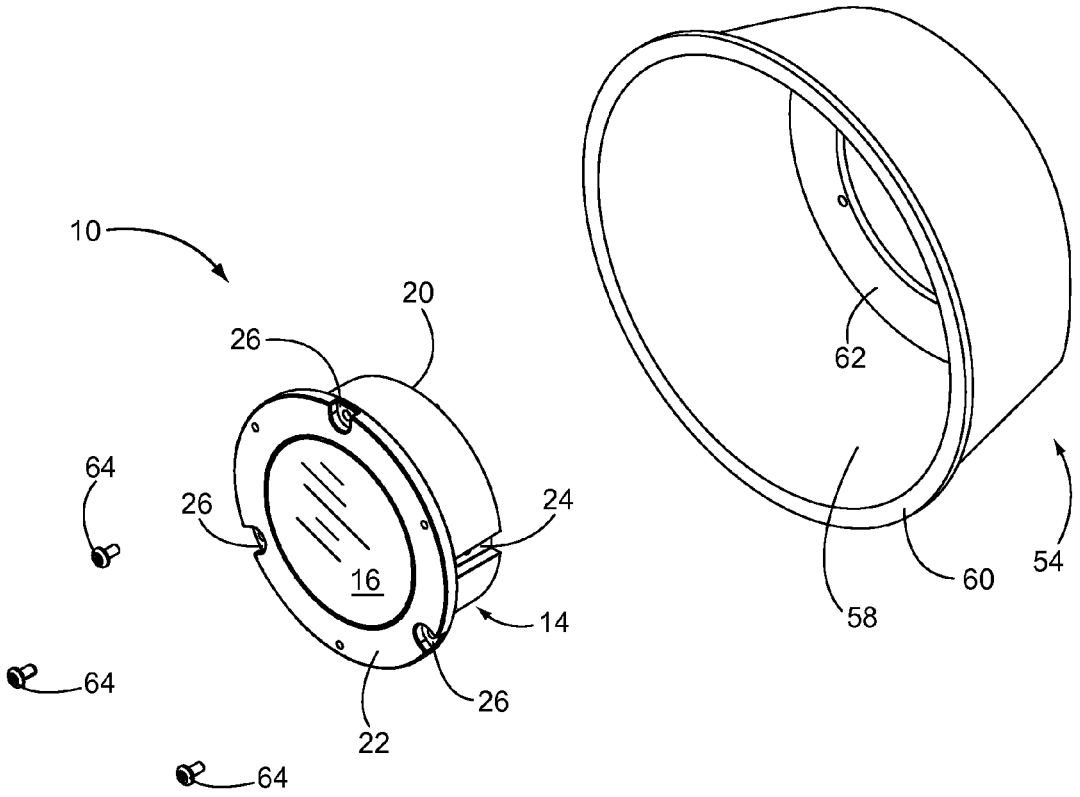
FIG. 15 is an exploded isometric view of the lighting fixture of FIG. 1 without the control module and with a mounting can.

FIG. 14 provides an exploded isometric view of an alternative embodiment wherein the heat sink 52 is attached to the lighting fixture 10 and mounting can 54 assembly of FIGS. 11-13. The bolts 66 extend through holes provided in the heat sink 52 and screw into threaded holes provided in the annular flange 62 of the mounting can 54. FIG. 15 provides an exploded isometric view of yet another alternative embodiment wherein the lighting fixture 10 in the assembly illustrated in FIGS. 11-13 is not provided with the control module 12. The power and control may be provided by a remote module (not illustrated), which provides all or a portion of the functionality of the control module electronics 28.

As illustrated in the embodiment of FIG. 4, the lens assembly 16 may have a substantially planar body that acts as primary lens wherein the tabs 40 extend from the periphery of the planar body in a direction that is substantially orthogonal to the plane in which the planar body resides. In essence, the lens assembly 16 provides a flat lens that is flush with, or at least substantially parallel with, the front face of the annular flange 22 of the heat spreading cup 14. However, other configurations for the lens assembly 16 are available. Various configurations for the lens assembly 16A through 16F are illustrated in FIGS. 16 through 37 and described in detail below. The composition of the lens assembly 16A through 16F may be the same as that described for the lens assembly 16.

In each of the illustrated embodiments, the heat spreading cup 14 is formed with a planar sidewall segment 70 in the normally cylindrical sidewall 18. In this embodiment, assume that the control module electronics 28 of the control module 12 are provided in a remote module (not shown), wherein the control module electronics 28 are connected to the light source 34 (FIGS. 4 and 7) via a wiring assembly 72. The wiring assembly 72 extends through the planar sidewall segment 70 of the heat spreading cup 14. In an alternative embodiment, the control module 12 with the control module electronics 28 may be mounted to the heat spreading cup 14 as described above.

Figure 16:
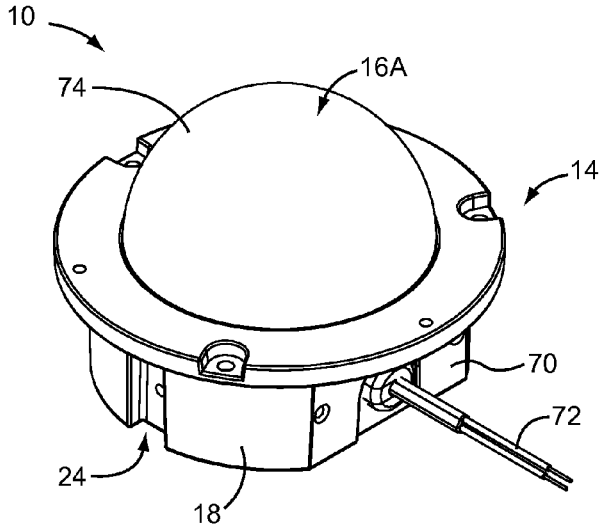
FIG. 16 is a front isometric view of a lens assembly according to a second embodiment.
Figure 17:
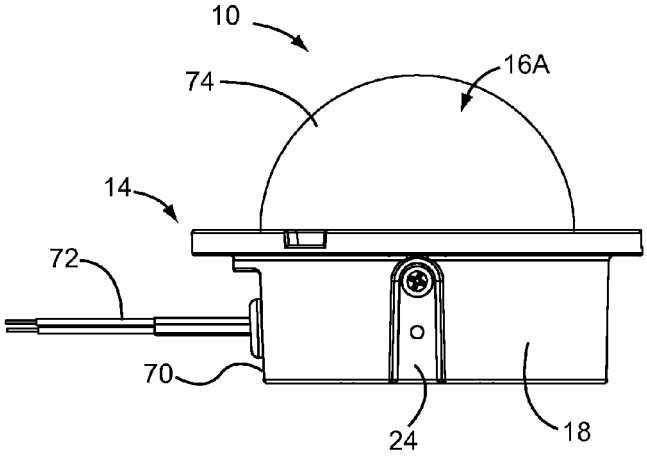
FIG. 17 is a side plan view of the lens assembly according to the second embodiment.
Figure 18:
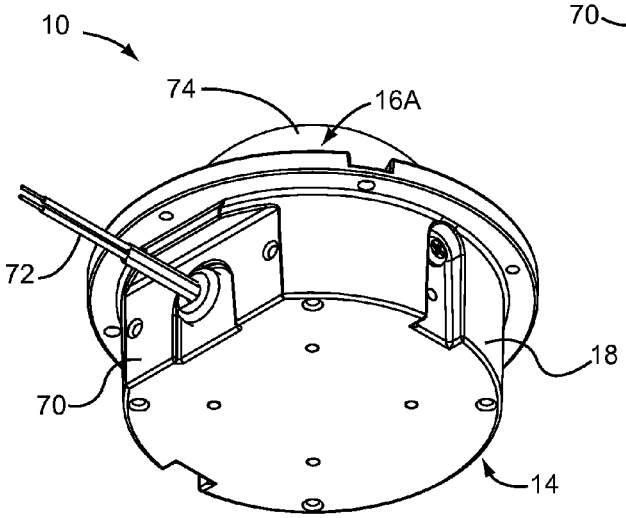
FIG. 18 is a rear isometric view of the lens assembly according to the second embodiment.

FIG. 16 provides a lighting fixture 10 that has a lens assembly 16A according to a second embodiment of the disclosure. The lens assembly 16A is provided wherein the primary lens portion 74 that has a substantially hemispherical or dome shape, as opposed to the substantially planar or disk shape of the aforementioned embodiments. FIGS. 17 and 18 respectively provide side and rear isometric views of the lighting fixture 10, which is illustrated in FIG. 16.

Figure 19:
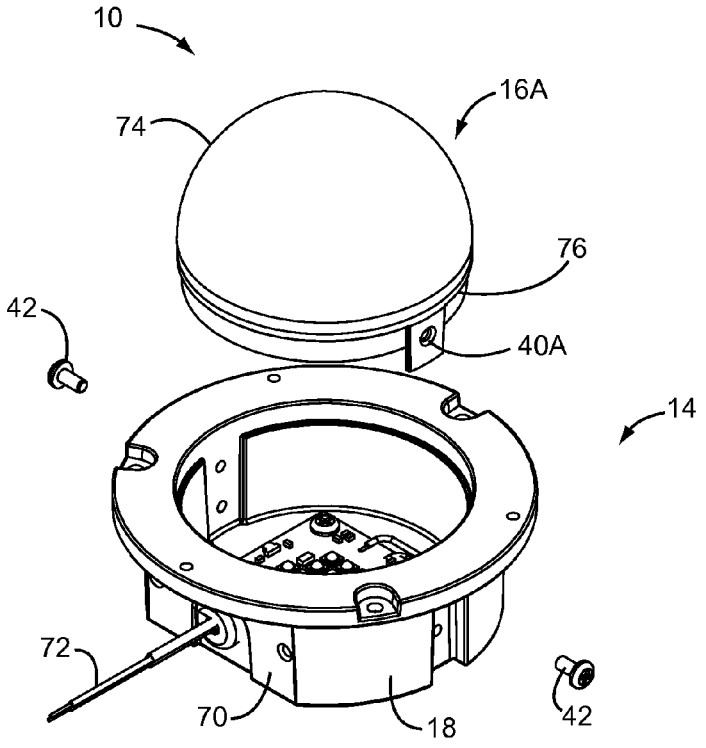
FIG. 19 is an exploded, front isometric view of the lens assembly according to the second embodiment.
Figure 20:
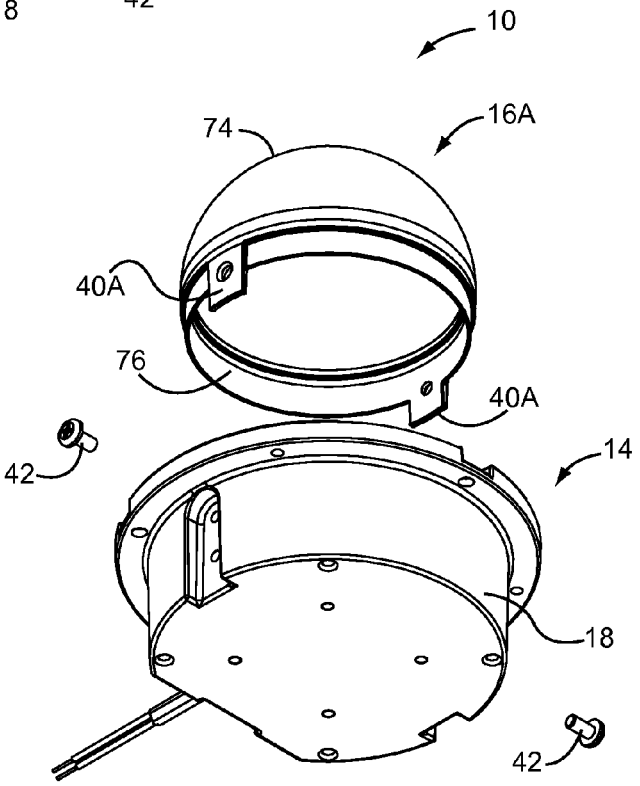
FIG. 20 is an exploded, rear isometric view of the lens assembly according to the second embodiment.
Figure 21:
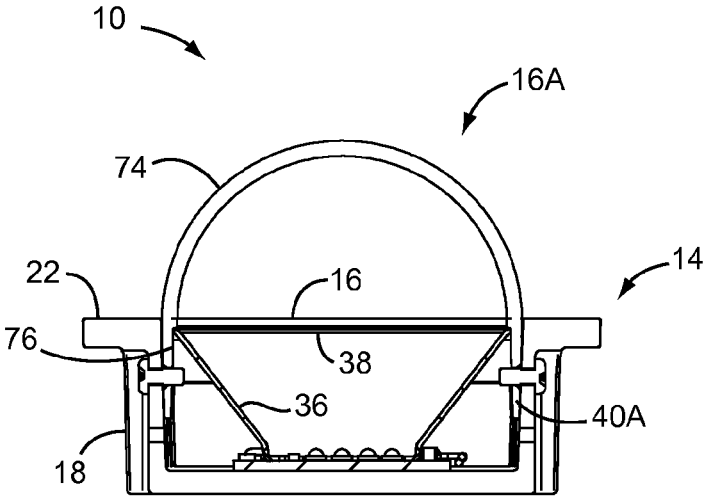
FIG. 21 is a cross-sectional view of the lens assembly according to the second embodiment.
Figure 22:
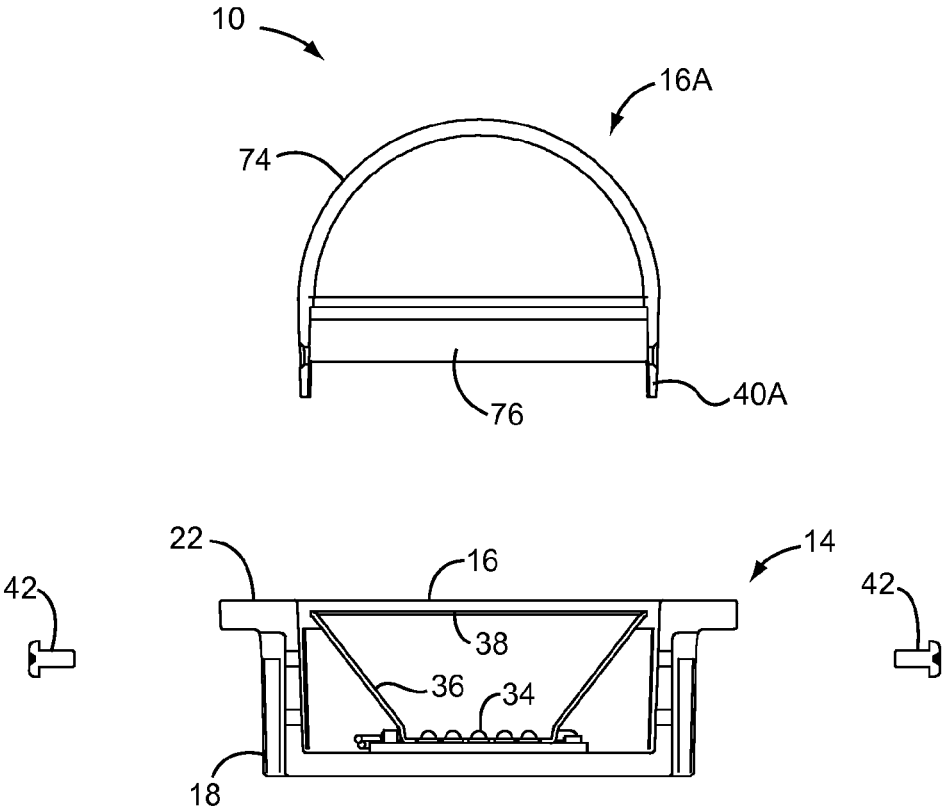
FIG. 22 is an exploded, cross-sectional view of the lens assembly according to the second embodiment.

In FIGS. 19 and 20, exploded isometric views of the lighting fixture 10 illustrate that the lens assembly 16A has a skirt 76 extending around the base of the primary lens portion 74. The reflector 36 is not shown for clarity. The tabs 40A extend rearward from the sides of the skirt 76. When assembled, the tabs 40A are received by slots that reside on the interior surface of the sidewall 18 of the heat spreading cup 14. The bolts or screws 42 extend through aligned openings in sidewall 18 and tabs 40A to securely affix the lens assembly 16A to the heat spreading cup 14. In one embodiment, either or both of the openings in the sidewall 18 and the tabs 40A are threaded in a complementary fashion with the bolts 42. FIG. 21 is an assembled cross-sectional view and FIG. 22 is an exploded cross-sectional view of the embodiment of FIG. 16. As illustrated, the skirt 76 and tabs 40A are received by the heat spreading cup 14 such that the hemispherical primary lens portion 74 of the lens assembly 16A extends past the front face of the annular flange 22.

Figure 23:
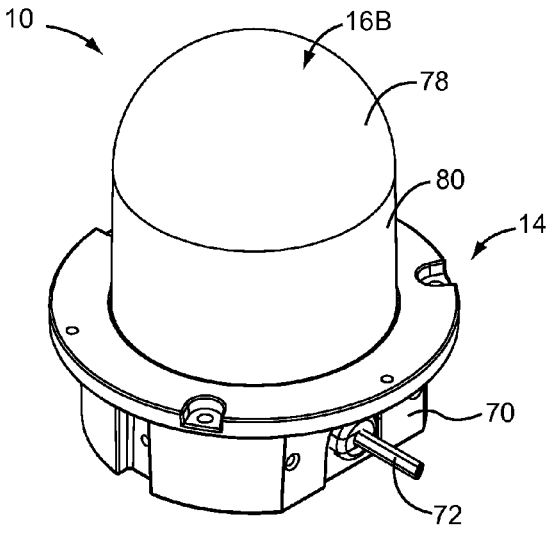
FIG. 23 is a front isometric view of a lens assembly according to a third embodiment.
Figure 24:
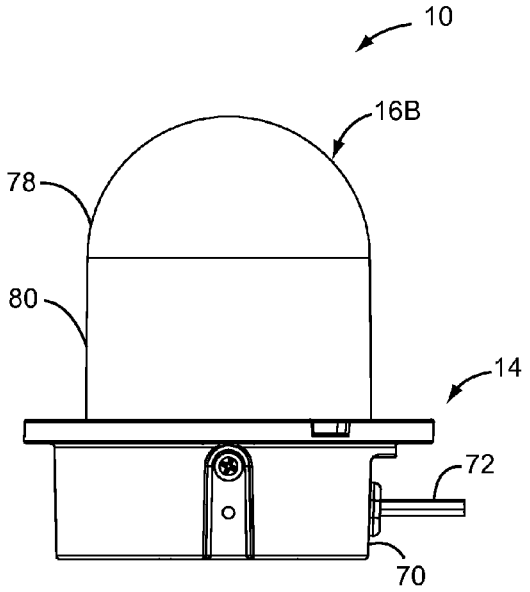
FIG. 24 is a side plan view of the lens assembly according to the third embodiment.
Figure 25:
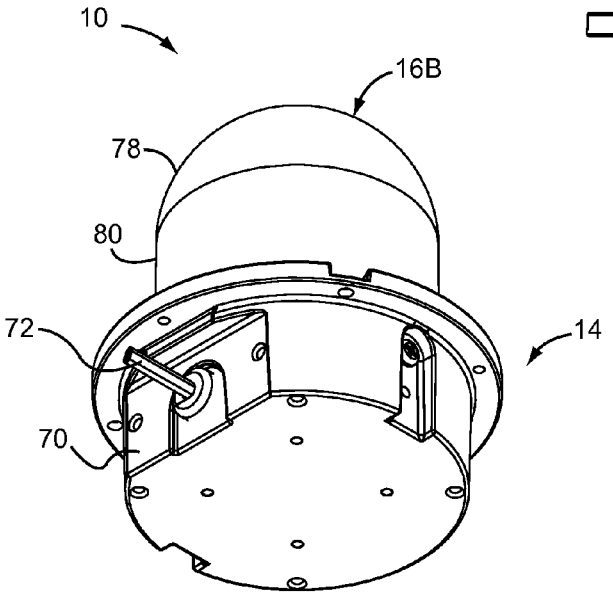
FIG. 25 is a rear isometric view of the lens assembly according to the third embodiment.

FIG. 23 provides a lighting fixture 10 that has a lens assembly 16B according to a third embodiment of the disclosure. The lens assembly 16B is provided wherein the primary lens portion has a substantially hemispherical or dome portion 78 that resides above a cylindrical portion 80 to form an elongated dome. FIGS. 24 and 25 respectively provide side and rear isometric views of the lighting fixture 10 illustrated in FIG. 23. The dome portion 78 resides on one end of the cylindrical portion 80, and a skirt 76 (see FIG. 19) resides along the other end of the cylindrical portion 80. Tabs 40A may extend rearward from the skirt 76 or the cylindrical portion 80 and are used to affix the lens assembly 16B to the heat spreading cup 14 as described above.

The heat spreading cup 14, or other light mounting structure, may be configured to allow the lighting fixture 10 to readily replace conventional, non-LED-based lighting fixtures, bulbs, assemblies, and the like. The specially configured mounting structure could be configured to readily attach to, plug into, thread into, or otherwise connect to existing receptacles, sockets, connectors, buses, and the like.

Figure 26:
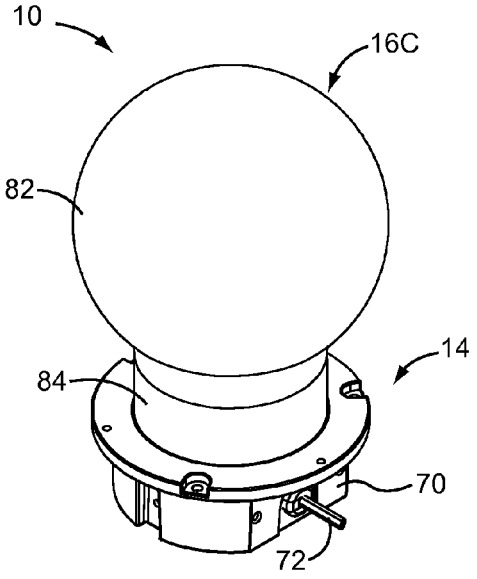
FIG. 26 is a front isometric view of a lens assembly according to a fourth embodiment.
Figure 27:
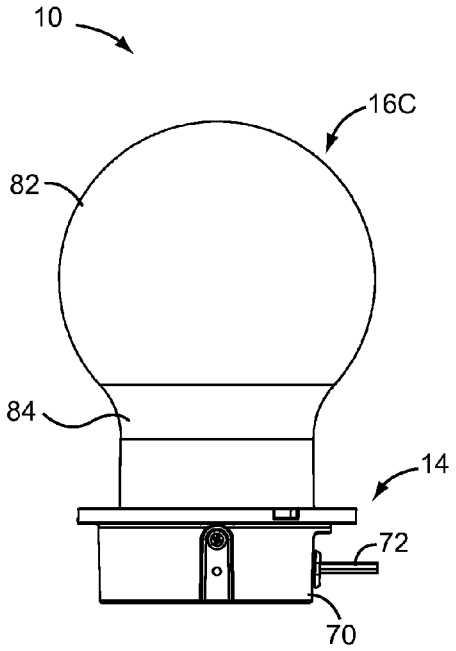
FIG. 27 is a side plan view of the lens assembly according to the fourth embodiment.
Figure 28:
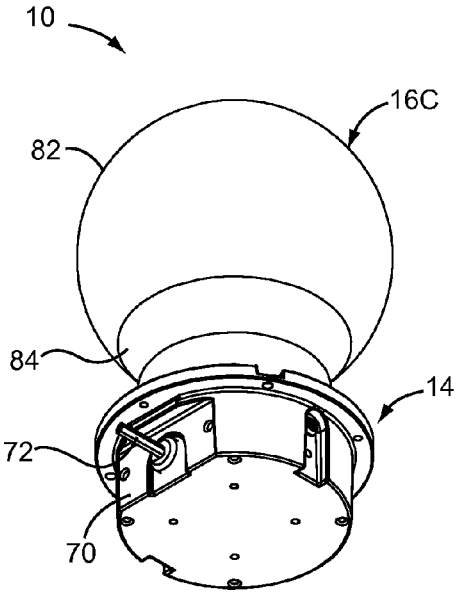
FIG. 28 is a rear isometric view of the lens assembly according to the fourth embodiment.

FIG. 26 provides a lighting fixture 10 that has a lens assembly 16C according to a fourth embodiment of the disclosure. The lens assembly 16C is provided wherein the primary lens portion has a substantially bulbous portion 82 that resides above a base portion 84, which has a substantially smaller diameter than the bulbous portion 82. As such, the lens assembly 16C takes on the shape of a traditional incandescent light bulb. FIGS. 27 and 28 respectively provide side and rear isometric views of the lighting fixture 10 illustrated in FIG. 26. The bulbous portion 82 resides on one end of the base portion 84, and a skirt 76 (see FIG. 19) resides along the other end of the base portion 84. Tabs 40A may extend rearward from the skirt 76 or the base portion 84 and are used to affix the lens assembly 16C to the heat spreading cup 14 as described above.

Figure 29:
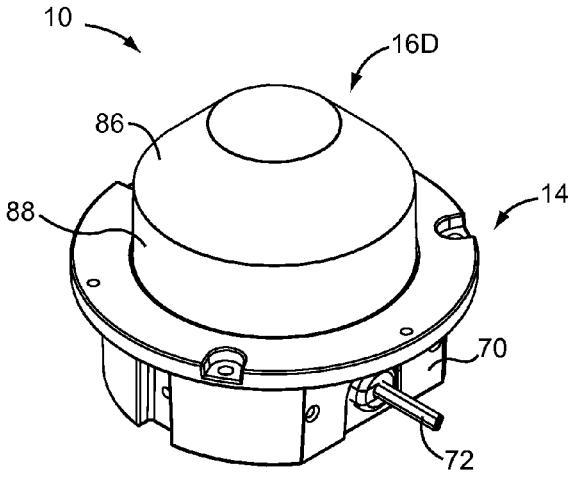
FIG. 29 is a front isometric view of a lens assembly according to a fifth embodiment.
Figure 30:
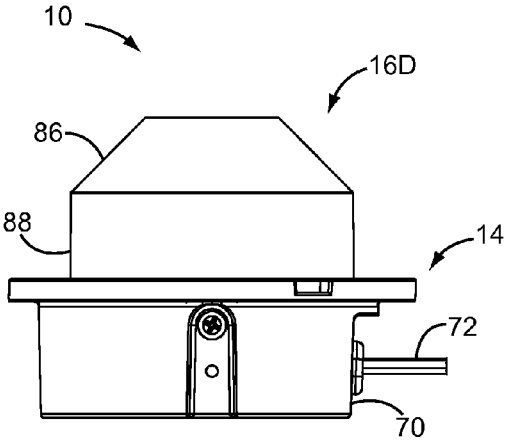
FIG. 30 is a side plan view of the lens assembly according to the fifth embodiment.
Figure 31:
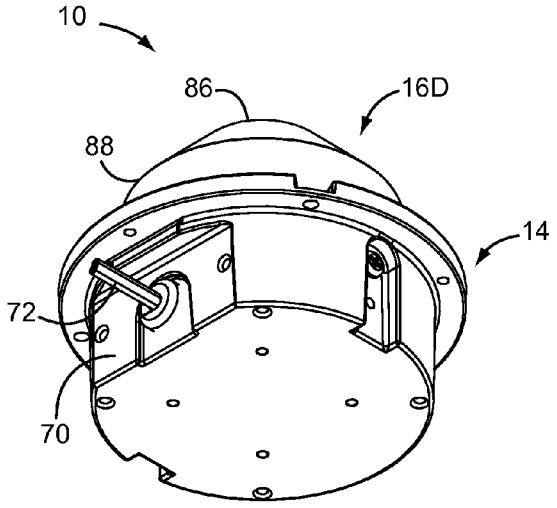
FIG. 31 is a rear isometric view of the lens assembly according to the fifth embodiment.

FIG. 29 provides a lighting fixture 10 that has a lens assembly 16D according to a fifth embodiment of the disclosure. The lens assembly 16D is provided wherein the primary lens portion has a substantially conical portion 86 that resides above a cylindrical portion 88. FIGS. 30 and 31 respectively provide side and rear isometric views of the lighting fixture 10, which is illustrated in FIG. 29. The conical portion 86 resides on one end of the cylindrical portion 88, and a skirt 76 (see FIG. 19) resides along the other end of the cylindrical portion 88. Tabs 40A may extend rearward from the skirt 76 or the cylindrical portion 88 and are used to affix the lens assembly 16D to the heat spreading cup 14 as described above.

Figure 32:
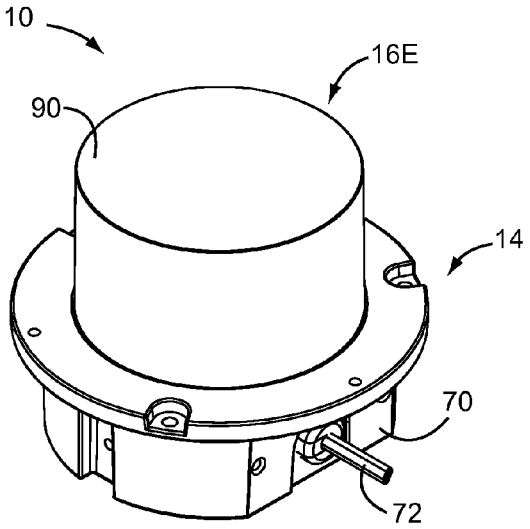
FIG. 32 is a front isometric view of a lens assembly according to a sixth embodiment.
Figure 33:
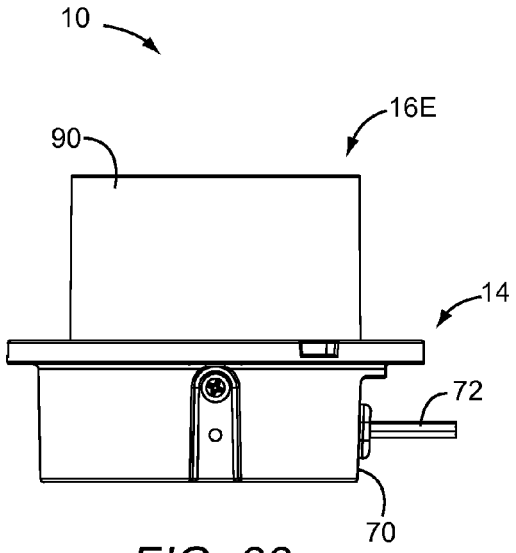
FIG. 33 is a side plan view of the lens assembly according to the sixth embodiment.
Figure 34:
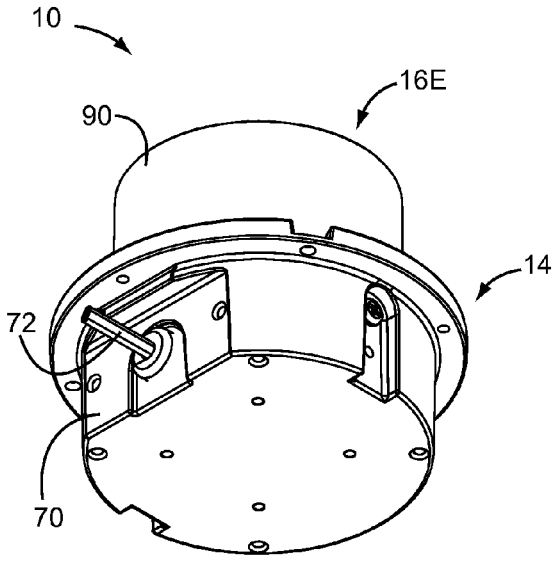
FIG. 34 is a rear isometric view of the lens assembly according to the sixth embodiment.

FIG. 32 provides a lighting fixture 10 that has a lens assembly 16E according to a sixth embodiment of the disclosure. The lens assembly 16E is provided wherein the primary lens portion is substantially a cylindrical portion 90. FIGS. 33 and 34 respectively provide side and rear isometric views of the lighting fixture 10 illustrated in FIG. 32. A skirt 76 (see FIG. 19) resides along the rearward end of the cylindrical portion 90. Tabs 40A may extend rearward from the skirt 76 or the cylindrical portion 90 and are used to affix the lens assembly 16E to the heat spreading cup 14 as described above.

Figure 35:
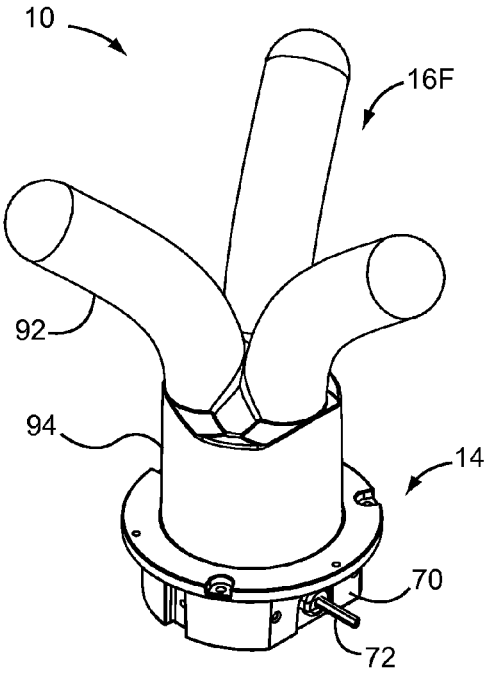
FIG. 35 is a front isometric view of a lens assembly according to a seventh embodiment.
Figure 36:
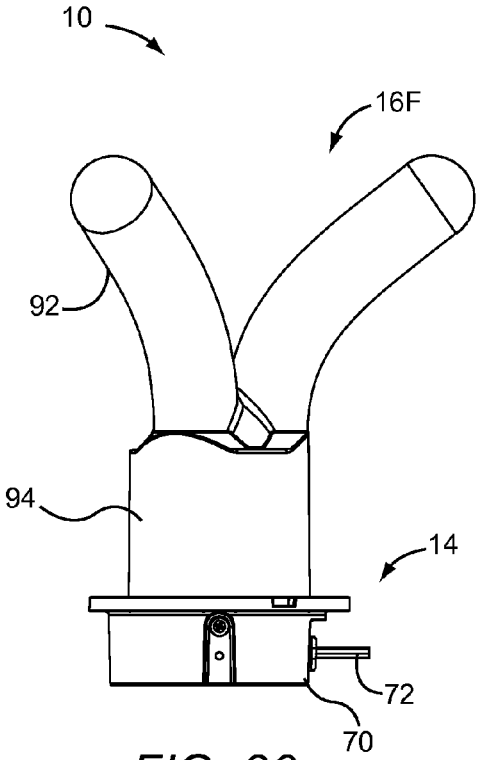
FIG. 36 is a side plan view of the lens assembly according to the seventh embodiment.
Figure 37:
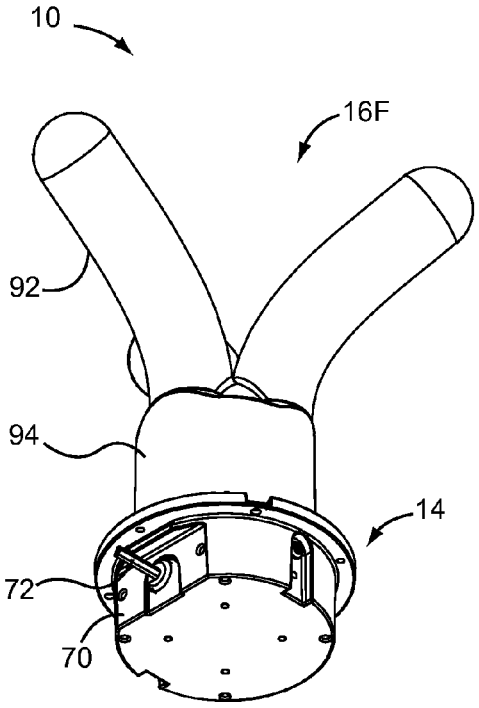
FIG. 37 is a rear isometric view of the lens assembly according to the seventh embodiment.

FIG. 35 provides a lighting fixture 10 that has a lens assembly 16F according to seventh embodiment of the disclosure. The lens assembly 16F is provided wherein the primary lens portion has a multi-tubular portion 92 that provides two or more light tubes. The multi-tubular portion 92 resides above a cylindrical portion 94 to form an elongated dome. FIGS. 36 and 37 respectively provide side and rear isometric views of the lighting fixture 10 illustrated in FIG. 35. The multi-tubular portion 92 resides on one end of the cylindrical portion 94, and a skirt 76 (see FIG. 19) resides along the other end of the cylindrical portion 94. Tabs 40A may extend rearward from the skirt 76 or the cylindrical portion 94 and are used to affix the lens assembly 16F to the heat spreading cup 14 as described above.

Figure 38:
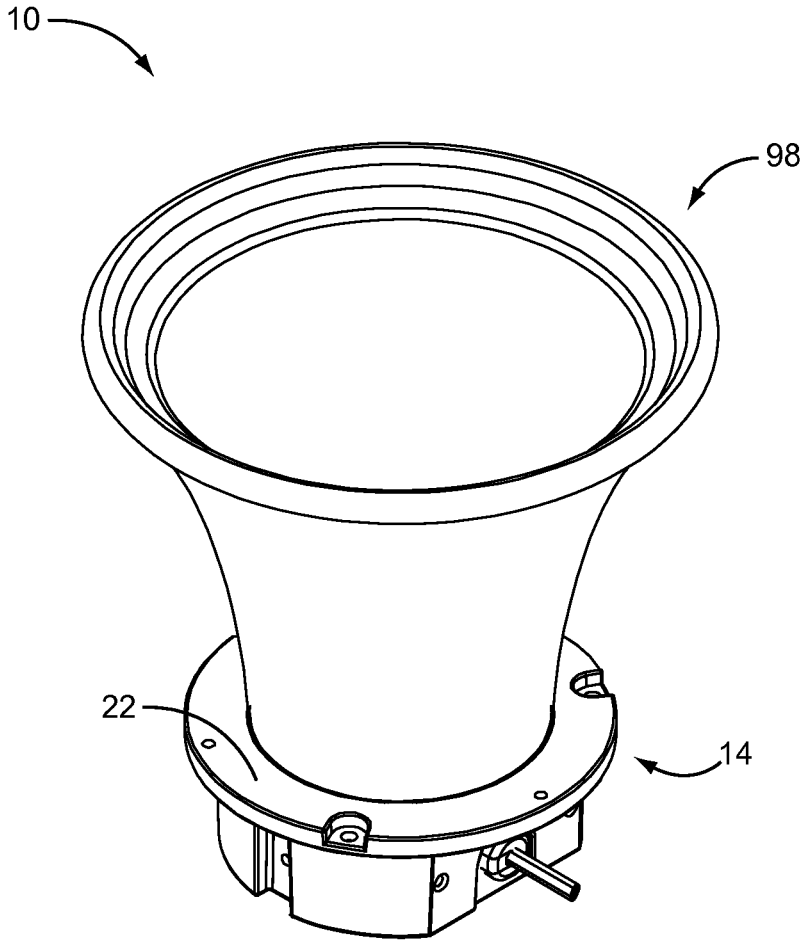
FIG. 38 is a front isometric view of a lens assembly according to an eighth embodiment.

Turning now to FIGS. 38 through 41, another embodiment of the lighting fixture 10 is provided. With particular reference to FIG. 38, a transparent or translucent decorative globe 98 is shown affixed to the front of the annular flange 22 of the heat spreading cup 14. The globe 98 may be formed from virtually any material and take on any desired shape. For example, the globe 98 may be formed of glass or a polymer and be either clear or frosted based on aesthetic choices.

Figure 39:
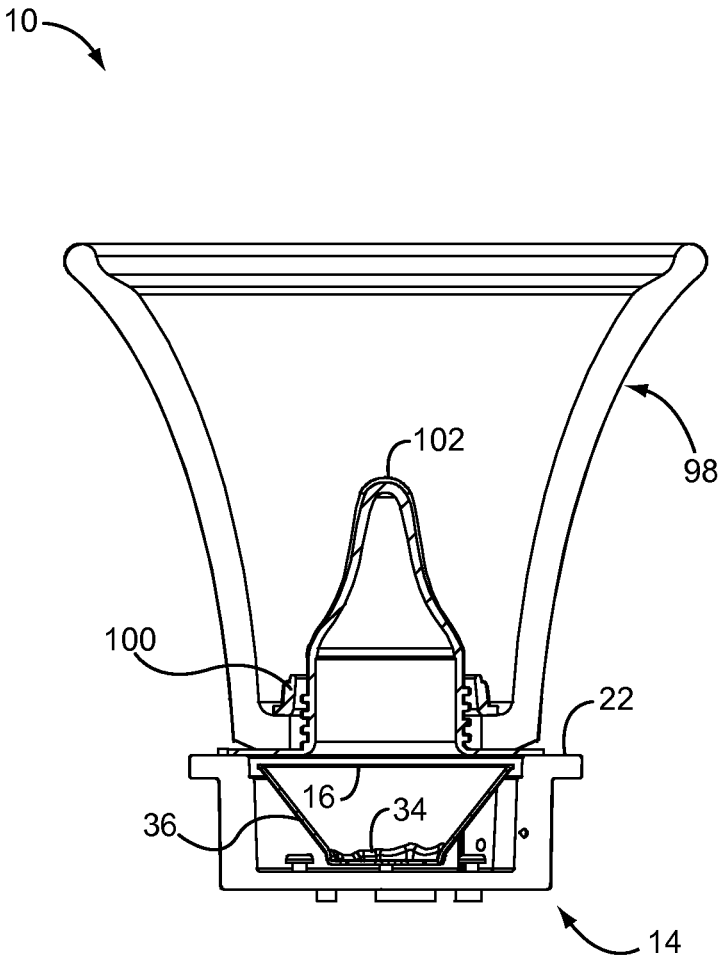
FIG. 39 is a cross-sectional view of the lens assembly according to the eighth embodiment.
Figure 40:
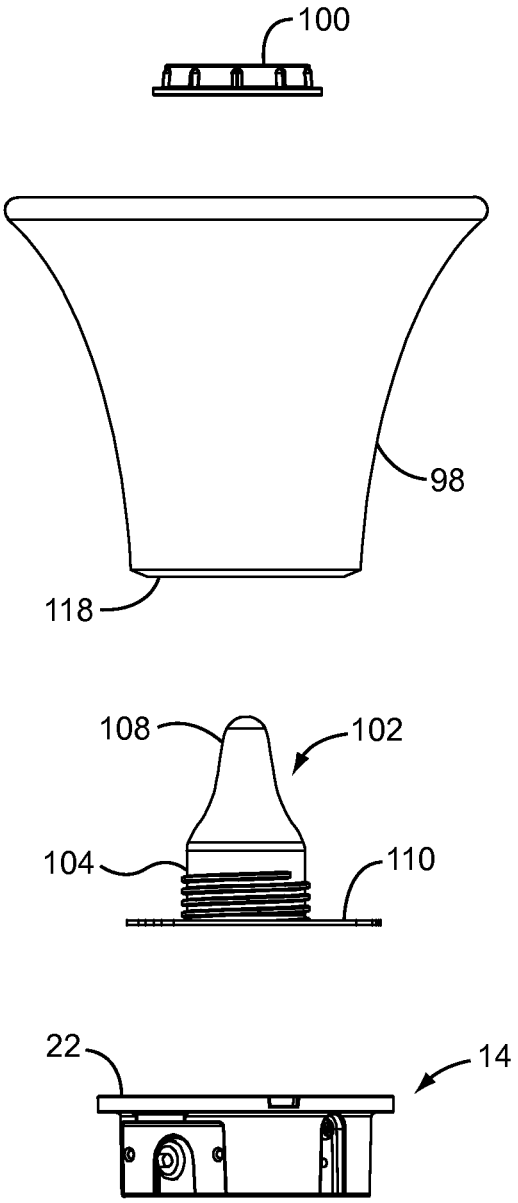
FIG. 40 is an exploded view of the lens assembly according to the eighth embodiment.
Figure 41:
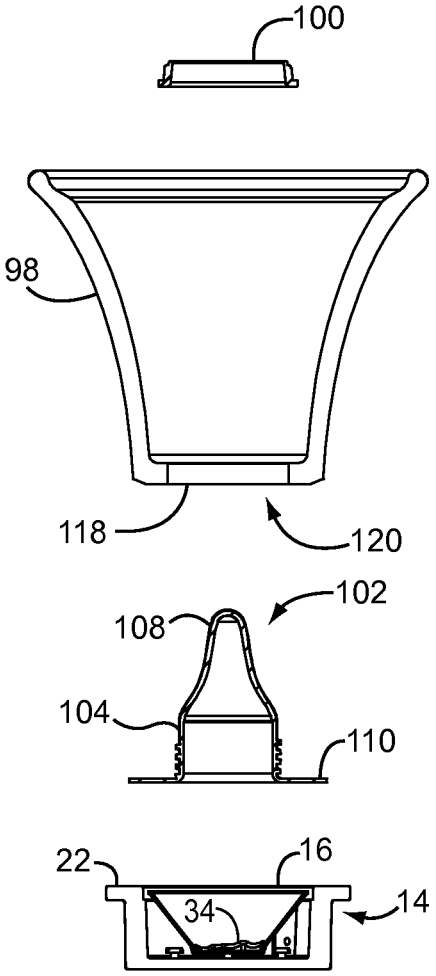
FIG. 41 is an exploded, cross-sectional view of the lens assembly according to the eighth embodiment.

FIGS. 39 through 41 illustrate a unique mechanism for attaching the globe 98 to the heat spreading cup 14. FIG. 39 is a cross-sectional view and FIGS. 40 and 41 are respectively exploded normal and exploded cross-sectional views of the lighting fixture 10. As illustrated, the lighting fixture 10 employs a connecting ring 100 and a lens adapter 102 to affix the globe 98 to the heat spreading cup 14. The connecting ring 100 has an opening with interior threads (not shown).

Figure 42:
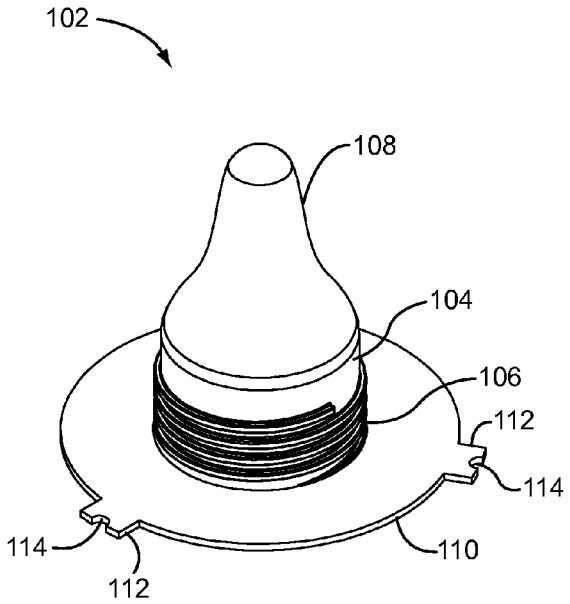
FIG. 42 is a front isometric view of a lens adapter according to the eighth embodiment.
Figure 43:
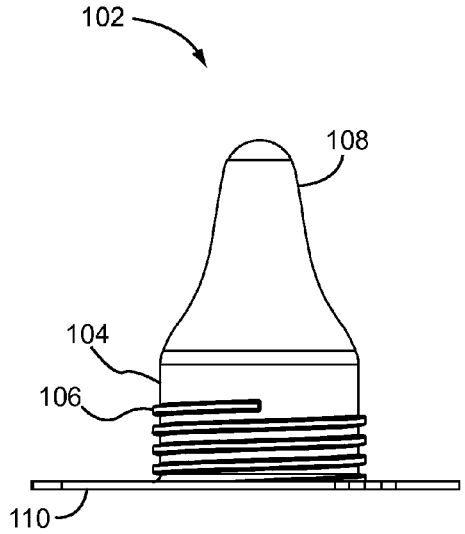
FIG. 43 is a side plan view of the lens adapter according to the eighth embodiment.
Figure 44:
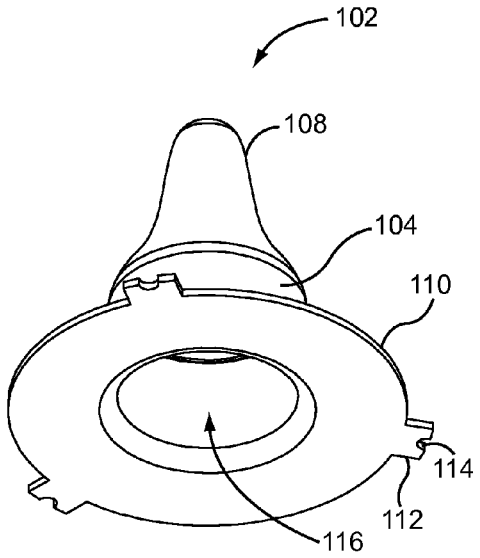
FIG. 44 is a rear isometric view of the lens adapter according to the eighth embodiment.

The lens adapter 102 functions as both a lens for light transmission and a connecting fixture as described below. Details for one embodiment of the lens adapter are depicted in FIGS. 42 through 44. In this embodiment, the lens adapter 102 has a cylindrical base 104 that is approximately the same diameter of the opening in the connecting ring 100. The base 104 also includes exterior threads 106, which mate with the interior threads of the connecting ring 100.

The lens adapter 102 also has a distal end 108 that is coupled or integrally formed on a first end of the base 104 and a flange 110 that is coupled to or integrally formed on a second end of the base 104. The flange 110 may be annular with an outside diameter that is substantially larger than the diameter of the base 104. The flange 110 may also have radially extending tabs 112, which have notches 114 or holes (not shown). The tabs 112 may be used to affix the flange 110 of the lens adapter 102 to the front face of the flange 22 of the heat spreading cup 14. As shown in FIG. 44, the lens adapter 102 may be substantially hollow, thus forming an interior opening 116.

While the base 104, distal end 108, and flange 110 may be separately formed, the illustrated embodiment is uniformly formed from a transparent or translucent polymeric material or glass. Together, the base 104 and the distal end 108 may be shaped to appear as a more traditional incandescent light bulb. While shown in a "flame tipped" configuration, any type of shape is available, including traditional bulbs, globes, and the like.

With reference again to FIGS. 39 through 41, the flange 110 of the lens adapter 102 may be affixed to the flange 22 of the heat spreading cup 14 using bolts or screws that extend through the notches 114 (or holes) of the tabs 112. Other means for affixing the lens adapter 102 to the heat spreading cup 14 are envisioned and deemed within the scope of this disclosure. Depending on the configuration of the lighting fixture 10, the normal lens assembly 16 and diffuser 38 may or may not be used, as the lens adapter 102 may act as the lens and perhaps a diffuser as well. If either the lens assembly 16, diffuser 38, or both are used, the lens adapter 102 will rest on or over the lens assembly 16 or diffuser 38. In either case, light emanating from the array of LEDs 50 will pass through the diffuser 38 and lens assembly 16, if provided, into the interior opening 116 of the lens adapter 102. The light will then pass through at least the distal end 108, and perhaps through a portion of the base 104 of the lens adapter.

The globe 98 has a base 118 with an opening 120 that is sized to receive the base 104 of the lens adapter 102. When the base 118 of the globe 98 rests on the upper surface of the flange 110 of the lens adapter, the raised threads 106 of the base 104 extend into the interior of the globe 98. The connecting ring 100 slides over the distal end 108 of the lens adapter 102 and threads onto the raised threads 106 of the base 104 to secure the globe to the lens adapter 102, and thus to the heat spreading cup 14. In this configuration, the combination of the lens adapter 102 and the globe 98 provide a decorative lighting fixture 10 that appears to be a conventional globe-based fixture with a flame-tipped incandescent light bulb. Multiple ones of these assemblies may be provided in a single fixture for a multi-light fan lighting kit, vanity light, track light assembly, sconce, ceiling light, and the like.

Figure 45:
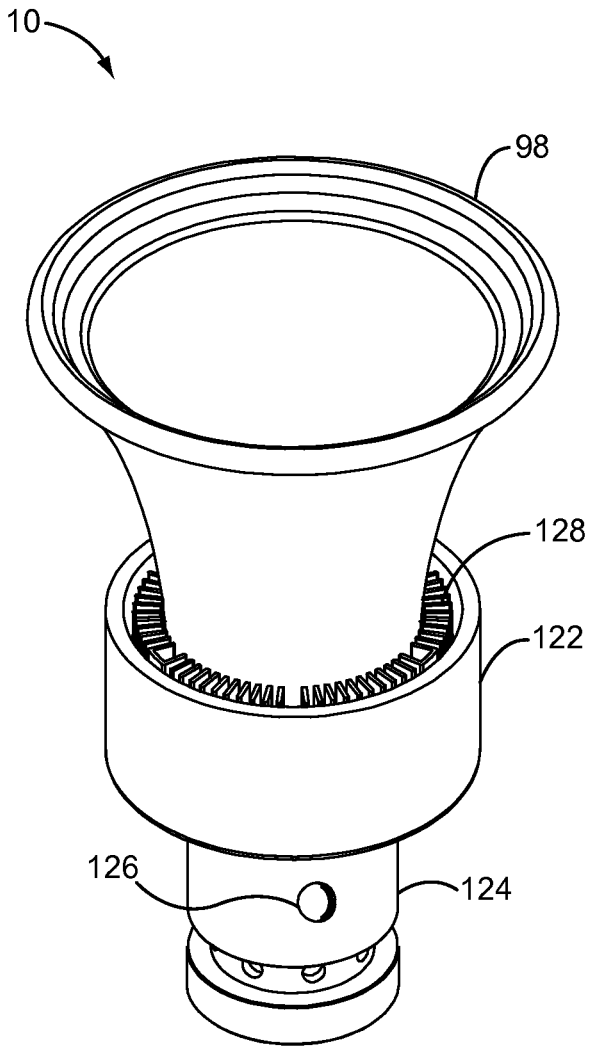
FIG. 45 is a front isometric view of a lighting device assembly according to a ninth embodiment.
Figure 46:
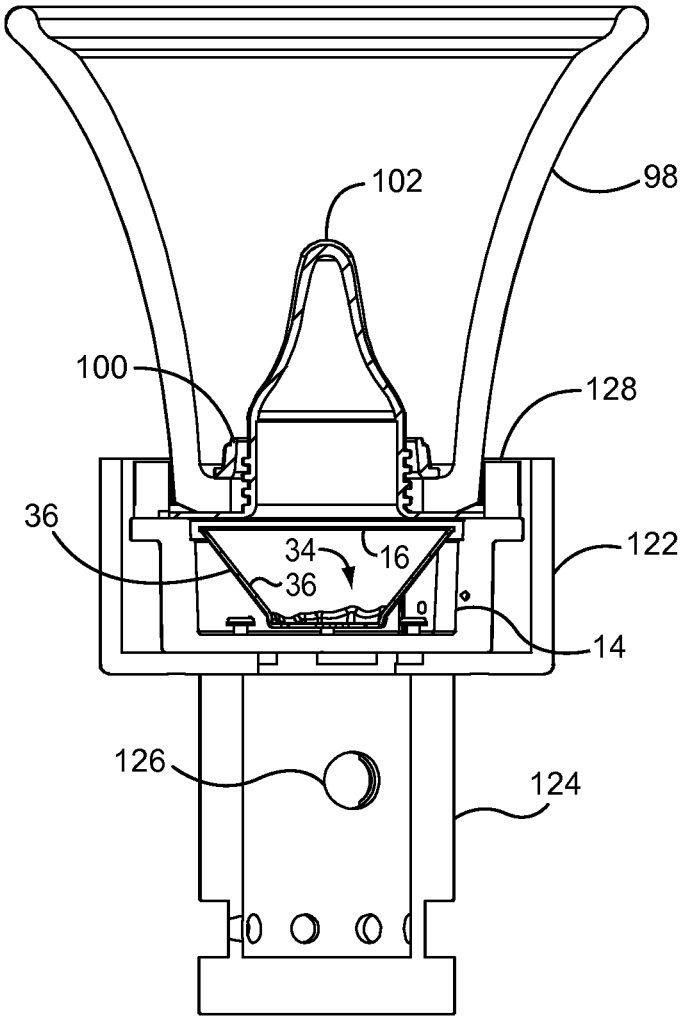
FIG. 46 is a cross-sectional view of the lens assembly according to the ninth embodiment.
Figure 47:
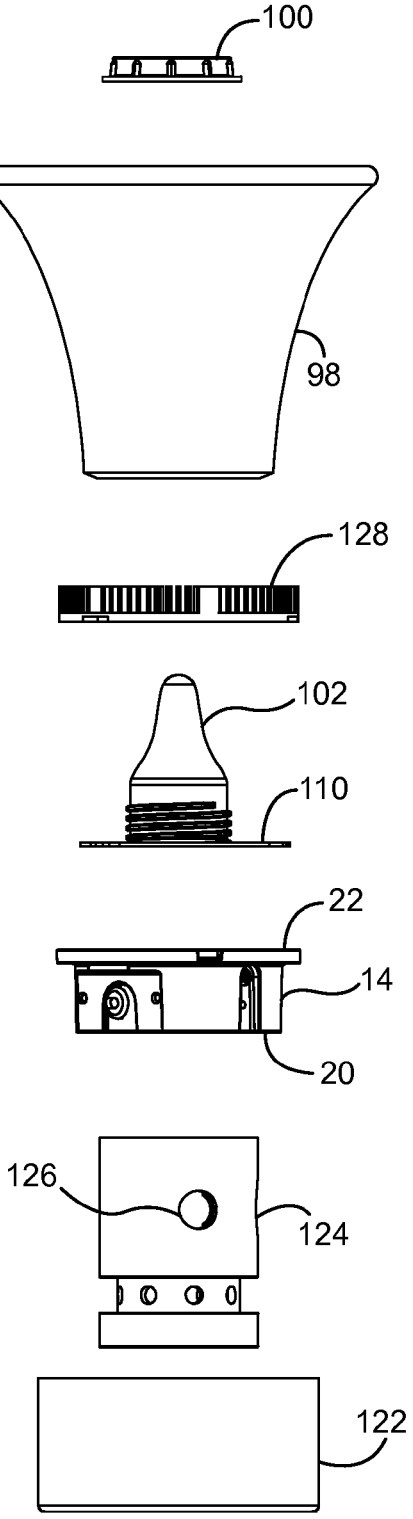
FIG. 47 is an exploded view of the lens assembly according to the ninth embodiment.

FIGS. 45 through 47 illustrate an exemplary mounting assembly for the lighting fixture 10. The mounting assembly includes a shroud 122 and a mounting bracket 124. The shroud 122 is cup-shaped and has a bottom and cylindrical sidewalls. The opening of the shroud 122 is sized to receive the heat spreading cup 14 wherein the inside surface of the bottom of the shroud 122 is mounted against the rear of the bottom panel 20 of the heat spreading cup 14.

The bottom of the shroud 122 may have an opening sized to receive the mounting bracket 124. In this embodiment, the mounting bracket 124 is tubular and also mounts to the bottom panel 20 of the heat spreading cup 14 or the bottom of the shroud 122. The mounting bracket 124 allows the lighting fixture 10 to be readily mounted to any structure or fixture that is capable of securely receiving or affixing to the mounting bracket 124. An aperture 126 may be provided in the body of the mounting bracket 124 to facilitate mounting or running cabling to the light source 34.

To assist with dissipating heat generated by the light source 34, an annular heat sink 128 may be provided along the flange 22 of the heat spreading cup 14. The heat sink 128 may reside in an annular opening that is bounded on three sides by the front surface of the flange 22, the outside surface of the base of the globe 98, and the inside surface of the sidewalls of the shroud 122. The heat sink 128 is in thermal contact with the flange 22 on a rear side and exposed to ambient on the front side to facilitate heat dissipation during operation of the lighting fixture 10.

For assembly, the heat sink 128 may also be used to hold the lens adapter 102 in place. For instance, the heat sink 128 may be attached to the flange 22, and the flange 110 of the lens adapter 102 is sandwiched between an inside portion of the heat sink 128 and the flange 22. In such an embodiment, care should be taken to ensure efficient thermal contact between an outer portion of the heat sink 128 and the flange 22 of the heat spreading cup 14.

Figure 48:
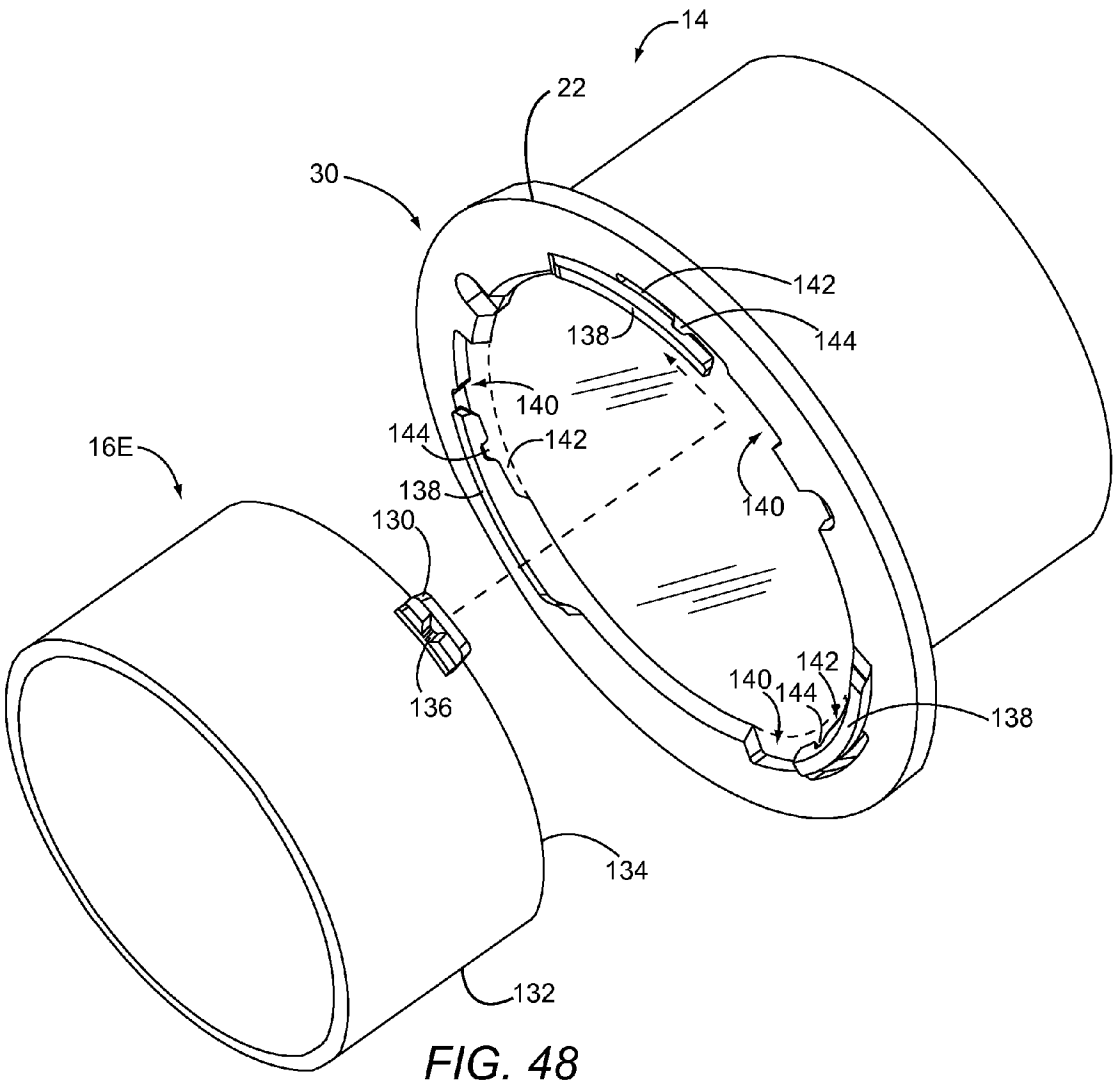
FIG. 48 is an isometric view of a lens assembly according to a tenth embodiment.

With reference to FIG. 48, an alternative embodiment for connecting the lens assembly 16, such as lens assembly 16E to the heat spreading cup 14. The prior embodiments, took advantage of the tabs 40A (FIGS. 19-21) wherein the tabs where bolted to the sides of the heat spreading cup 14. However, the present embodiment employs a "twist-lock" mechanism, as described below.

FIG. 48 provides an enlarged view of the heat spreading cup 14 and the lens assembly 16E. Instead of the tabs 40A and the skirt 76, multiple trim ears 130 (only one shown) are provided on an outer surface of the body 132 and at or near the rear edge 134 of the lens assembly 16E. The ears 130 are used to securely attach the lens assembly 16E to the flange 22 of the heat spreading cup 14. The trim ears 130 extend radially outward from the outer surface of the body 132 and may have a tab 136 formed on the forward or rear surfaces thereof. The forward surface of the flange 22 has multiple locking members 138 and slots 140. Each locking member 134 is an elongated and deflectable cantilever that resides substantially parallel to the forward surface of the planar lens assembly 16 (as shown), diffuser 38, or the like. A channel 142 is formed between each locking member 134 and the surface of the lens assembly 16, diffuser 38, or the like in the illustrated embodiment; however, the channel 142 could be formed entirely within the flange 22. The slots 140 are provided in the flange 22 and are in communication with the corresponding channels 142.

The ears 130 have a defined length and thickness. The slots 140 are wider than the length of the ears 130, and the channels 142 have a thickness approximating that of the ears 130. As such, the lens assembly 16E can be aligned and moved along a center axis toward the heat spreading cup 14, such that the ears 130 of the lens assembly 16E are slid into the slots 140 of the flange 22. Once the ears 130 of the lens assembly 16E are in the slots 140 of the flange 22, the ears 130 will slide into the channel 142 as the lens assembly 16E is rotated in the appropriate direction about the center axis. In the illustrated embodiment, the locking members 138 are configured such that the lens assembly 16E must be rotated counter-clockwise to move the ears 130 into the respective channels 142. The channels 142 may be sized to provide a friction fit for the ears 130 between the locking members 138 and the planar lens assembly 16, diffuser 38, or the like. As such, the locking members 138 may slightly deflect away from the planar lens assembly 16 as the ears 130 enter and move along the respective channels 142, wherein the ears 130 are held in place by being pinned between the locking members 138 and the planar lens assembly 16 (or other surface). The surface of locking members 138 that faces rearward may also have a notch 144 that is complementary to the ear tab 136 of the ear 130. The notch 144 is positioned along the channel 142 such that the tabs 136 of the ears 130 engage the notches 144 when the lens assembly 16E is rotated into place.

Those skilled in the art will recognize improvements and modifications to the embodiments of the present disclosure. All such improvements and modifications are considered within the scope of the concepts disclosed herein.

What is claimed is:

1. A lighting fixture comprising:

a mounting structure having a rim at an end of at least one sidewall;

a light source coupled inside the mounting structure and configured to emit light in a forward direction through an opening formed by the rim; and a lens assembly comprising:

a skirt that extends inside the mounting structure;

at least two tabs that extend from a side of the skirt in a rearward direction that is opposite the forward direction and is coupled to the mounting structure, wherein at least one tab of the at least two tabs is coupled to an interior surface of the at least one sidewall of the mounting structure; and a primary lens portion that is unitary with the skirt such that the at least two tabs extend from the primary lens via the skirt, where the primary lens projects in the forward direction substantially past the rim, and covers the opening provided by the rim.

2. The lighting fixture of claim 1 wherein the primary lens portion is dome shaped.

3. The lighting fixture of claim 1 wherein the primary lens portion comprises a dome portion and a cylindrical portion that extends between the dome portion and the skirt.

4. The lighting fixture of claim 1 wherein the primary lens portion comprises a bulbous portion and a base portion that extends between the bulbous portion and the skirt.

5. The lighting fixture of claim 1 wherein the primary lens portion comprises a conical portion and a cylindrical portion that extends between the conical portion and the skirt.

6. The lighting fixture of claim 1 wherein the primary lens portion comprises a planar lens and a cylindrical portion that extends between the planar lens and the skirt.

7. The lighting fixture of claim 1 wherein the primary lens portion comprises a multi-tubular portion and a cylindrical portion that extends between the multi-tubular portion and the skirt.

8. The lighting fixture of claim 1 wherein the light source is thermally coupled to a bottom panel of the mounting structure such that heat generated by the light source during operation is transferred radially outward along the bottom panel and in the forward direction along the at least one sidewall toward the rim.

9. The lighting fixture of claim 1 wherein the primary lens portion is substantially perpendicular to a central axis of the mounting structure and the tabs are substantially parallel to the central axis.

10. The lighting fixture of claim 9 wherein the interior surface of the at least one sidewall comprises at least one channel in which the at least one tab is received.

11. The lighting fixture of claim 10 further comprising an attachment implement, and wherein the at least one channel further comprises a first hole that extends through the at least one sidewall and aligns with a second hole in the at least one tab when the lens assembly is in place, the attachment implement extending through the first hole and into the second hole to hold the lens assembly in place.

12. The lighting fixture of claim 11 wherein an exterior surface of the at least one sidewall comprises at least one elongated slot substantially aligned with the at least one channel and the first hole resides in the at least one elongated slot.

13. The lighting fixture of claim 1 further comprising a reflector having a body extending between a smaller opening substantially adjacent and about a light emitting element of the light source and a larger opening biased toward the opening formed by the rim.

14. The lighting fixture of claim 1 wherein the light source comprises a light emitting diode.

15. The lighting fixture of claim 1 further comprising a control module having electronics to control the light source and coupled to an exterior surface of a bottom panel of the mounting structure, wherein heat generated by the electronics during operation is transferred radially outward along the bottom panel and in the forward direction along the at least one sidewall toward the rim.

16. The lighting fixture of claim 15 further comprising a heat sink coupled to the exterior surface of the bottom panel.

17. The lighting fixture of claim 15 wherein the mounting structure is formed from at least one of a metal and a ceramic.

18. The lighting fixture of claim 1 wherein the rim is substantially annular and the at least one sidewall is substantially cylindrical.

19. The lighting fixture of claim 18 wherein the rim is provided by a flange.

20. The lighting fixture of claim 1 wherein the light source is LED-based and the mounting structure is configured to allow the lighting fixture to replace a conventional, non-LED-based lighting fixture.

21. The lighting fixture of claim 1, wherein the lens assembly is configured such that the light emitted from the light source is only emitted through the primary lens portion.

* * * * *